US011332934B2

(12) United States Patent
Matsuno et al.

(10) Patent No.: US 11,332,934 B2
(45) Date of Patent: May 17, 2022

(54) TYING MACHINE

(71) Applicant: MAKITA CORPORATION, Anjo (JP)

(72) Inventors: Tadasuke Matsuno, Anjo (JP); Yoshitaka Machida, Anjo (JP)

(73) Assignee: MAKITA CORPORATION, Anjo (JP)

( * ) Notice: Subject to any disclaimer, the term of this patent is extended or adjusted under 35 U.S.C. 154(b) by 406 days.

(21) Appl. No.: 16/476,767

(22) PCT Filed: Sep. 22, 2017

(86) PCT No.: PCT/JP2017/034377
§ 371 (c)(1),
(2) Date: Jul. 9, 2019

(87) PCT Pub. No.: WO2018/131218
PCT Pub. Date: Jul. 19, 2018

(65) Prior Publication Data

US 2020/0385991 A1 Dec. 10, 2020

(30) Foreign Application Priority Data

Jan. 10, 2017 (JP) ..... JP2017-001973
Jan. 10, 2017 (JP) ..... JP2017-001974
Jan. 10, 2017 (JP) ..... JP2017-001975

(51) Int. Cl.
*E04C 5/16* (2006.01)
*B65B 13/28* (2006.01)

(52) U.S. Cl.
CPC ..... *E04C 5/162* (2013.01); *B65B 13/285* (2013.01)

(58) Field of Classification Search
CPC ..... B23Q 11/0046; B21F 15/00; B21F 15/02; B21F 15/04; B21F 7/00; B21F 23/005;
(Continued)

(56) References Cited

U.S. PATENT DOCUMENTS 5,279,336 A * 1/1994 Kusakari ..... E04G 21/123 140/57
5,515,887 A 5/1996 Hanagasaki et al.
(Continued)

FOREIGN PATENT DOCUMENTS

CA 990634 A 6/1976
CN 1184521 A 6/1998
(Continued)

OTHER PUBLICATIONS

Nov. 24, 2020 Office Action issued in Japanese Patent Application No. 2017-001974.
(Continued)

*Primary Examiner* — Gregory D Swiatocha
*Assistant Examiner* — Bobby Yeonjin Kim
(74) *Attorney, Agent, or Firm* — Oliff PLC

(57) ABSTRACT

A tying machine disclosed herein includes a feed mechanism. The feed mechanism includes a feed roller that feeds a tying string; a feed motor that rotates the feed roller; a cover disposed between the feed roller and the feed motor, and including a through hole; and a suppression member that suppresses movement of dust from a feed roller side to a feed motor side via the through hole. Another tying machine disclosed herein includes a reel on which a tying string is wound; a brake member that engages with the reel to brake the reel; and an actuator that drives the brake member. The brake member is interposed between the reel and the actuator. Yet another tying machine disclosed herein includes a housing; a reel on which a tying string is wound; a magnet that rotates integrally with the reel; and a magnetic sensor attached to the housing.

5 Claims, 33 Drawing Sheets

(58) Field of Classification Search
CPC ..... B21F 23/00; B65B 13/28; B65B 13/285; B65B 13/025; B25B 25/00; E04G 21/123
USPC ..... 408/67
See application file for complete search history.

(56) References Cited

U.S. PATENT DOCUMENTS

| | | | | |
|---|---|---|---|---|
| 5,657,799 | A | 8/1997 | Kusakari et al. | |
| 5,983,473 | A | 11/1999 | Yuguchi et al. | |
| 8,813,375 | B2 * | 8/2014 | Okumura | B27G 19/04 30/390 |
| 2005/0061389 | A1 * | 3/2005 | Nakagawa | E04G 21/123 140/119 |
| 2006/0011254 | A1 | 1/2006 | Yokochi et al. | |
| 2006/0283516 | A1 | 12/2006 | Nagaoka et al. | |
| 2007/0199610 | A1 * | 8/2007 | Itagaki | E04G 21/122 140/93.6 |
| 2008/0134908 | A1 | 6/2008 | Nagaoka et al. | |
| 2009/0126824 | A1 | 5/2009 | Nakagawa et al. | |
| 2009/0283167 | A1 | 11/2009 | Nakagawa et al. | |
| 2009/0283170 | A1 * | 11/2009 | Nagaoka | E04G 21/123 140/119 |
| 2009/0283171 | A1 | 11/2009 | Nagaoka et al. | |
| 2009/0283172 | A1 | 11/2009 | Itagaki | |
| 2010/0147411 | A1 | 6/2010 | Kusakari et al. | |
| 2010/0313991 | A1 | 12/2010 | Nagaoka et al. | |
| 2011/0030836 | A1 | 2/2011 | Nagaoka et al. | |
| 2011/0049230 | A1 | 3/2011 | Nagaoka et al. | |
| 2014/0091171 | A1 | 4/2014 | Nakagawa et al. | |
| 2014/0246114 | A1 | 9/2014 | Kusakari et al. | |
| 2014/0246115 | A1 | 9/2014 | Itagaki | |
| 2014/0262569 | A1 | 9/2014 | Inoue et al. | |
| 2014/0299393 | A1 | 10/2014 | Matsuda | |
| 2014/0302353 | A1 | 10/2014 | Ogura | |
| 2015/0267423 | A1 | 9/2015 | Kusakari et al. | |
| 2016/0222683 | A1 | 8/2016 | Kusakari et al. | |
| 2017/0130472 | A1 | 5/2017 | Nakagawa et al. | |
| 2018/0155940 | A1 * | 6/2018 | Nagaoka | E04G 21/123 |
| 2018/0363309 | A1 | 12/2018 | Kusakari et al. | |
| 2020/0002962 | A1 * | 1/2020 | Kawazoe | E04G 21/123 |

FOREIGN PATENT DOCUMENTS

| | | | |
|---|---|---|---|
| CN | 1561271 | A | 1/2005 |
| CN | 1688481 | A | 10/2005 |
| CN | 1768188 | A | 5/2006 |
| CN | 1950578 | A | 4/2007 |
| CN | 101585419 | A | 11/2009 |
| CN | 101585423 | A | 11/2009 |
| CN | 101586399 | A | 11/2009 |
| CN | 101748897 | A | 6/2010 |
| CN | 102133933 | A | 7/2011 |
| CN | 102556393 | A | 7/2012 |
| CN | 202559762 | U | 11/2012 |
| CN | 103889833 | A | 6/2014 |
| CN | 204895936 | U | 12/2015 |
| DE | 69534859 | T2 | 8/2006 |
| DE | 4413627 | B4 | 1/2008 |
| FR | 2430492 | A1 | 2/1980 |
| JP | H5-330507 | A | 12/1993 |
| JP | 11-156746 | A | 6/1999 |
| JP | 2003-175905 | A | 6/2003 |
| JP | 2004-027765 | A | 1/2004 |
| JP | 2005-194847 | A | 7/2005 |
| JP | 2006-027685 | A | 2/2006 |
| JP | 2009-275485 | A | 11/2009 |
| JP | 2010-001731 | A | 1/2010 |
| JP | 2014-203702 | A | 10/2014 |
| JP | 2016-097480 | A | 5/2016 |
| SU | 1108046 | A1 | 8/1984 |

OTHER PUBLICATIONS

Jun. 8, 2021 Office Action issued in Chinese Patent Application No. 201780082909.8.
Nov. 28, 2017 Written Opinion issued in International Patent Application No. PCT/JP2017/034377.
Nov. 28, 2017 Search Report issued in International Patent Application No. PCT/JP2017/034377.
Jun. 30, 2020 Office Action issued in Japanese Patent Application No. 2017-001975.
Oct. 2020 Office Action issued in Chinese Patent Application No. CN201780082909.8.
Dec. 17, 2021 Office Action issued in Chinese Patent Application No. 201780082909.8.

* cited by examiner

TYING MACHINE

TECHNICAL FIELD

The disclosure herein relates to a tying machine.

BACKGROUND ART

Japanese Patent Application Publication No. 2014-203702 describes a tying machine. The tying machine is provided with a feed mechanism. The feed mechanism is provided with a feed roller configured to feed a tying string, a feed motor configured to rotate the feed roller, and a cover that is disposed between the feed roller and the feed motor, and has a through hole.

Japanese Patent Application Publication No. 2010-1731 describes a tying machine. The tying machine is provided with a reel on which a tying string is wound, a brake member configured to engage with the reel to brake the reel, and an actuator configured to drive the brake member.

Japanese Patent Application Publication No. 2003-175905 describes a tying machine. The tying machine is provided with a housing, a reel on which a tying string is wound, a reflector disposed at the reel, and an optical sensor that is attached to the housing and includes a light emitter configured to emit light toward the reel and a light receiver configured to receive light reflected by the reflector.

SUMMARY OF INVENTION

Technical Problems

In the tying machine of Japanese Patent Application Publication No. 2014-203702, dust may occur due to wear of the tying string and/or the feed roller, the dust may move from a feed roller side to a feed motor side via the through hole of the cover. A technique that can suppress dust from moving from a feed roller side to a feed motor side via a through hole has been awaited.

The tying machine of Japanese Patent Application Publication No. 2010-1731 requires a complicated mechanism in order to suppress foreign matter from entering a space where the actuator is housed from a space where the reel is housed. A technique that can prevent foreign matter from affecting an actuator with a simple configuration has been awaited.

In the tying machine of Japanese Patent Application Publication No. 2003-175905, rotation of the reel may not be accurately detected when the reflector of the reel is contaminated. A technique that can accurately detect rotation of a reel even when the reel is contaminated has been awaited.

The disclosure herein provides a technique that can solve at least one of the problems described above.

Solution to Technical Problem

A tying machine disclosed herein may comprise a feed mechanism. The feed mechanism may include: a feed roller configured to feed a tying string; a feed motor configured to rotate the feed roller; a cover disposed between the feed roller and the feed motor and including a through hole; and a suppression member configured to suppress movement of dust from a feed roller side to a feed motor side via the through hole.

According to the above configuration, even when dust occurs due to wear of the tying string and/or the feed roller, the suppression member can suppress the dust from moving to the feed motor side from the feed roller side via the through hole of the cover. It is possible to prevent dust from affecting the feed motor adversely.

Another tying machine disclosed herein may comprise a reel on which a tying string is wound; a brake member configured to engage with the reel to brake the reel; and an actuator configured to drive the brake member. The brake member may be interposed between the reel and the actuator.

According to the above configuration, the brake member serves as a partition wall between the reel and the actuator, thus it is possible to prevent foreign matter from affecting the actuator adversely, with a simple configuration.

Yet another tying machine disclosed herein may comprise a housing; a reel on which a tying string is wound; a magnet configured to rotate integrally with the reel; and a magnetic sensor attached to the housing.

According to the above configuration, rotation of the reel can be detected from magnetic change of the magnet detected by the magnetic sensor. It is possible to accurately detect rotation of the reel even when the reel is contaminated.

Yet another tying machine disclosed herein may comprise a housing; a reel on which a tying string is wound; a turntable rotatably retained by the housing and configured to retain the reel and integrally rotate with the reel; and a detector configured to detect relative movement between the turntable and the housing.

According to the above configuration, rotation of the reel can be detected by detecting relative movement between the turntable and the housing by the detector. It is possible to accurately detect rotation of the reel even when the reel is contaminated.

DESCRIPTION OF EMBODIMENTS

Figure 1:
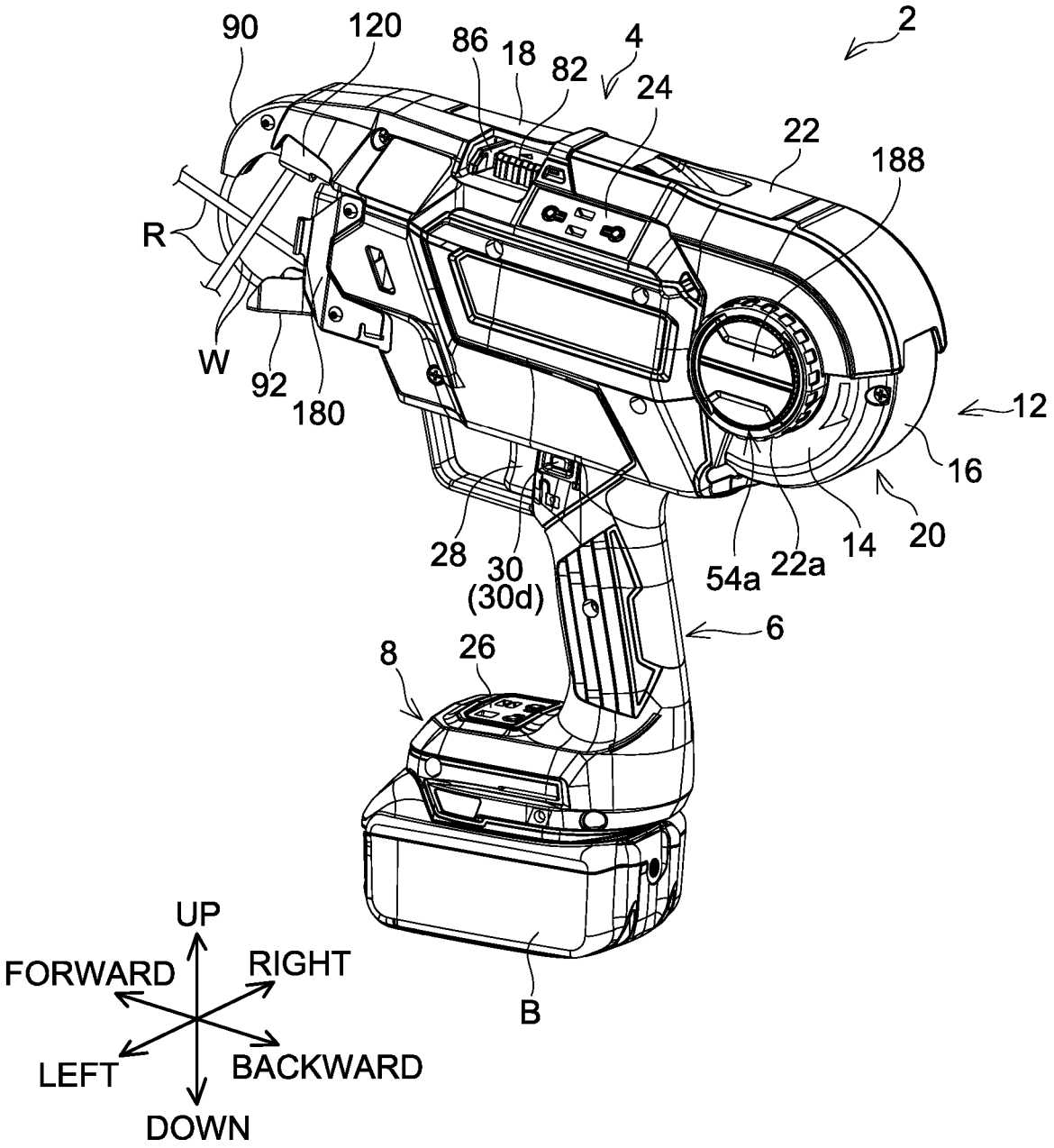
FIG. 1 is a perspective view seeing a rebar tying machine 2 according to an embodiment from an upper left rear side.

In one or more embodiments, a tying machine may comprise a feed mechanism. The feed mechanism may include a feed roller configured to feed a tying string; a feed motor configured to rotate the feed roller; a cover disposed between the feed roller and the feed motor, and including a through hole; and a suppression member configured to suppress movement of dust from a feed roller side to a feed motor side via the through hole.

According to the above configuration, even when dust occurs due to wear of the tying string and/or the feed roller, the suppression member can suppress the dust from moving to the feed motor side from the feed roller side via the through hole of the cover. It is possible to prevent dust from affecting the feed motor adversely.

In one or more embodiments, the tying machine may further comprise a rotation transmission mechanism configured to transmit rotation of the feed motor to the feed roller via the through hole.

In a case where the rotation transmission mechanism configured to transmit rotation of the feed motor to the feed roller via the through hole is provided, dust that has occurred due to wear of the tying string and/or the feed roller is likely to move to the feed motor side via the through hole of the cover. According to the above configuration, however, the suppression member can suppress the dust from moving to the feed motor side from the feed roller side via the through hole of the cover. It is possible to prevent the dust from affecting the feed motor adversely.

In one or more embodiments, the suppression member may be a dust-proof bearing.

According to the above configuration, the dust-proof bearing can rotatably support the feed roller and the rotation transmission mechanism and further can suppress the dust from moving to the feed motor side from the feed roller side via the through hole of the cover.

In one or more embodiments, the feed mechanism may further include a reduction mechanism disposed on the feed motor side as seen from the cover and configured to reduce rotation of the feed motor and transmit it to the feed roller.

According to the above configuration, the suppression member can suppress the dust from moving to the feed motor side from the feed roller side via the through hole of the cover, thus it is possible to prevent the dust from adversely affecting the reduction mechanism which is disposed on the feed motor side as seen from the cover.

In one or more embodiments, at least the feed roller, the feed motor, the cover and the suppression member may be configured as a unit.

According to the above configuration, assembly workability for the tying machine can be improved.

In one or more embodiments, the feed mechanism may further include a guide member disposed on the feed roller side as seen from the cover and configured to guide the tying string to the feed roller. The guide member may be fixed to the cover so as to prevent the suppression member from being removed from the cover.

According to the above configuration, the guide member can guide the tying string to the feed roller and further can prevent the suppression member from being removed from the cover.

In one or more embodiments, the guide member may include an insertion hole through which the tying string is guided. As seen from the guide member, an inlet of the insertion hole may be open to at least an opposite side from a cover side.

According to the above configuration, a user can easily insert a tip of the tying string into the insertion hole when setting the tying string in the feed mechanism.

In one or more embodiments, a tying machine may comprise a reel on which a tying string is wound; a brake member configured to engage with the reel to brake the reel; and an actuator configured to drive the brake member. The brake member may be interposed between the reel and the actuator.

According to the above configuration, the brake member serves as a partition wall between the reel and the actuator, thus it is possible to prevent foreign matter from adversely affecting the actuator with a simple configuration.

In one or more embodiments, only the brake member may be interposed between the reel and the actuator.

According to the above configuration, there is no need to provide a partition wall between the reel and the actuator in a housing of the tying machine, thus the reel and the actuator can be arranged close to each other, by which the tying machine can be further downsized.

In one or more embodiments, the actuator may include a solenoid. The solenoid may be disposed such that a longitudinal direction of the solenoid is substantially parallel to a tangential direction of rotary motion of a portion of the reel that is closest to the solenoid.

In a case where the actuator is a solenoid, the solenoid can be arranged close to the reel by disposing the solenoid such that a longitudinal direction of the solenoid is substantially parallel to a tangential direction of rotary motion of a portion of the reel that is closest to the solenoid can arrange the solenoid, by which the tying machine can be downsized. On the other hand, disposing the solenoid as such also makes a broad region of the solenoid face the reel, by which the solenoid may become susceptive to foreign matter. According to the above configuration, however, the brake member is interposed between the reel and the actuator, thus it is possible to prevent foreign matter from adversely affecting the actuator and downsize the tying machine further.

In one or more embodiments, the brake member may include a rib projecting towards the reel or the actuator.

According to the above configuration, durability of the brake member can be improved.

In one or more embodiments, the brake member may be a single member including a driving arm connected to the actuator and a braking arm configured to engage with the reel, and may be pivotable about a pivot axis. The braking arm may engage with the reel by the actuator driving the driving arm to cause torque to act on the brake member about the pivot axis.

According to the above configuration, it is possible to simplify a mechanism for the actuator to drive the brake member.

In one or more embodiments, the tying machine may further comprise a reel housing compartment that houses the reel therein. The reel housing compartment may include a water drainage hole.

According to the above configuration, even when water flows into the reel housing compartment, the water can be discharged from the reel housing compartment through the water drainage hole.

In one or more embodiments, the water drainage hole may include a labyrinth structure.

According to the above configuration, the water drainage hole includes the labyrinth structure, thus it is possible to prevent foreign matter from entering inside of the reel housing compartment through the water drainage hole.

In one or more embodiments, the water drainage hole may be disposed at a position through which an inside of the reel housing compartment is not seen in a rear view of the tying machine.

According to the above configuration, the water drainage hole is disposed at the position that is not seen in the rear view of the tying machine, thus it is possible to prevent the rotating reel from being exposed to the user who is on the rear side of the tying machine. User safety can further be improved.

In one or more embodiments, a tying machine may comprise a housing; a reel on which a tying string is wound; a magnet configured to rotate integrally with the reel; and a magnetic sensor attached to the housing.

According to the above configuration, rotation of the reel can be detected from magnetic change of the magnet detected by the magnetic sensor. It is possible to accurately detect rotation of the reel even when the reel is contaminated.

In one or more embodiments, the tying machine may further comprise a turntable rotatably retained by the housing and configured to retain the reel and integrally rotate with the reel. The magnet may be attached to the turntable.

According to the above configuration, even when the magnet is not attached to the reel, rotation of the reel can be detected from magnetic change of the magnet of the turntable detected by the magnetic sensor.

In one or more embodiments, the housing may include a plurality of housing plates, and the magnetic sensor may be attached to at least one of the housing plates that rotatably retains the turntable.

According to the above configuration, it is possible to accurately position the magnet of the turntable with respect to the magnetic sensor.

In one or more embodiments, a tying machine may comprise a housing; a reel on which a tying string is wound; a turntable rotatably retained by the housing and configured to retain the reel and integrally rotate with the reel; and a detector configured to detect relative movement between the turntable and the housing.

According to the above configuration, rotation of the reel can be detected by detecting relative movement between the turntable and the housing by the detector. Even when the reel is contaminated, rotation of the reel can be accurately detected.

In one or more embodiments, the detector may include a magnet attached to the turntable; and a magnetic sensor attached to the housing.

According to the above tying machine, relative movement between the turntable and the housing can be detected from magnetic change of the magnet of the turntable detected by the magnetic sensor, by which rotation of the reel can be detected.

In one or more embodiments, the housing may include a plurality of housing plates, and the magnetic sensor may be attached to at least one of the housing plates that rotatably retains the turntable.

According to the above configuration, it is possible to accurately position the magnet of the turntable with respective to the magnetic sensor.

In one or more embodiments, the detector may include a reflector attached to the turntable; and an optical sensor that is attached to the housing and includes a light emitter configured to emit light toward the turntable and a light receiver configured to receive light reflected by the reflector.

According to the above tying machine, relative movement between the turntable and the housing can be detected from change in the light reflected by the reflector of the turntable that is detected by the light receiver, by which rotation of the reel can be detected. Since there is no need to provide the reflector at the reel, rotation of the reel can be accurately detected even when the reel is contaminated.

(Embodiment)

A rebar tying machine 2 according to an embodiment will be described with reference to the drawings. The rebar tying machine 2 shown in FIG. 1 is a power tool for tying a plurality of rebars R with a wire W.

Figure 2:
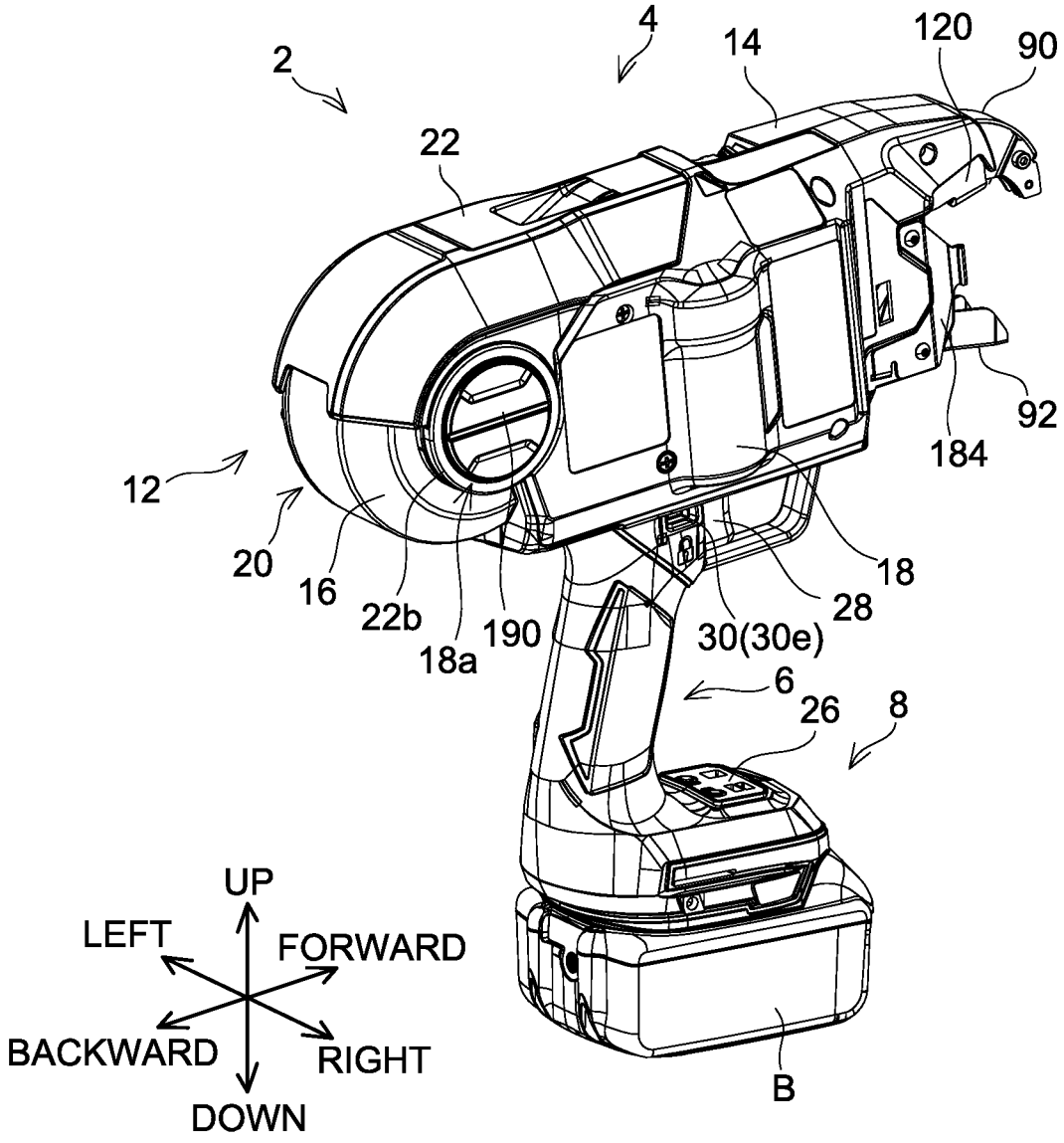
FIG. 2 is a perspective view seeing the rebar tying machine 2 according to the embodiment from an upper right rear side.
Figure 3:
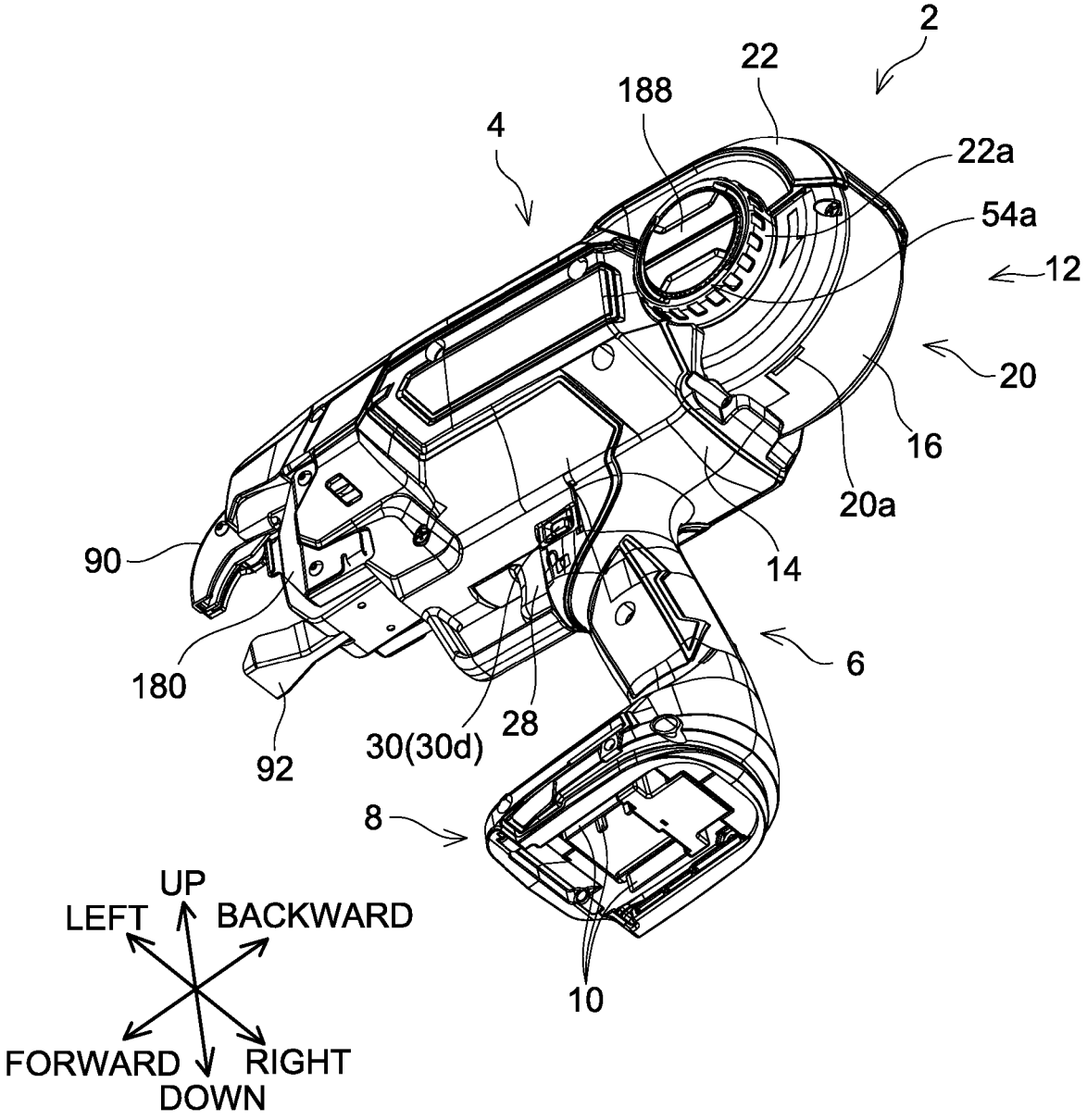
FIG. 3 is a perspective view seeing the rebar tying machine 2 according to the embodiment from a lower left rear side.

As shown in FIGS. 1 and 2, the rebar tying machine 2 includes a tying machine body 4, a grip 6 provided below the tying machine body 4 and which a user can grip, and a battery receiver 8 provided below the grip 6. A battery B is detachably attached to a lower part of the battery receiver 8. The battery B is a slide-type battery which is detachably attached by being slid relative to the battery receiver 8. The battery B is, for example, a lithium ion battery which is rechargeable by a charger which is not shown. When the battery B is attached to the battery receiver 8, power is supplied to the rebar tying machine 2 from the battery B. As shown in FIG. 3, battery terminals 10 configured to electrically connect with the battery B are provided on a lower surface of the battery receiver 8. The battery terminals 10 are electrically connected to a control board 200 (see FIG. 8) housed in a lower part of the tying machine body 4. The control board 200 controls various operations of the rebar tying machine 2.

As shown in FIGS. 1 and 2, the rebar tying machine 2 includes a housing 12. The housing 12 includes a left housing 14, a right housing 16, and a side-surface cover housing 18. The left housing 14, the right housing 16, and the side-surface cover housing 18 are all members constituted of resin. The left housing 14, the right housing 16, and the side-surface cover housing 18 can be regarded as a plurality of housing plates constituting the housing 12. As shown in FIG. 1, the left housing 14 integrally forms an outer shape of a left half of the tying machine body 4, an outer shape of a left half of the grip 6, and an outer shape of a left half of the battery receiver 8. As shown in FIG. 2, the right housing 16 integrally forms a part of an outer shape of a right half of the tying machine body 4, an outer shape of a right half of the grip 6, and an outer shape of a right half of the battery receiver 8. The left housing 14 is fixed to the right housing 16 with a plurality of screws. The side-surface cover housing 18 forms a part of the outer shape of the right half of the tying machine body 4. The side-surface cover housing 18 is fixed to the right housing 16 with a plurality of screws. A reel housing compartment 20 for housing a wire reel WR (see FIG. 7) is provided at a rear part of the tying machine body 4. The reel housing compartment 20 has its top part covered by a reel cover 22. The reel cover 22 is retained by the tying machine body 4 via circular ring-shaped attaching portions 22*a*, 22*b* provided respectively on left and right sides, and is configured to open and close the reel housing compartment 20 by rotating relative to the tying machine body 4 with a left-and-right direction as a rotary axis.

As shown in FIG. 1, a first manipulation/indicator unit 24 is provided at an upper left part of the tying machine body 4 near its center in a front-and-rear direction. The first manipulation/indicator unit 24 includes a main switch for switching power of the rebar tying machine 2 between on and off, a main power LED indicating an on/off state of the power of the rebar tying machine 2, and the like. The first manipulation/indicator unit 24 is electrically connected to the control board 200. The first manipulation/indicator unit 24 is arranged such that its manipulation/indicator surface inclines from an upper right side to a lower left side in a rear view of the tying machine body 4. With the first manipulation/indicator unit 24 arranged to incline as above, the user of the rebar tying machine 2 can achieve good visibility of the first manipulation/indicator unit 24 in either case of seeing the tying machine body 4 from the left side or from above. Further, with the first manipulation/indicator unit 24 arranged to incline as above, a dead space inside the tying machine body 4 can be reduced and the tying machine body 4 can be made compact as compared to a case where the first manipulation/indicator unit 24 is arranged along an upper surface or a side surface of the tying machine body 4.

A second manipulation/indicator unit 26 is provided on an upper front surface of the battery receiver 8. The second manipulation/indicator unit 26 includes setting buttons for setting a feed amount and twisting strength of the wire W, 7-segment LEDs for indicating contents set by the setting buttons, and the like. The second manipulation/indicator unit 26 is electrically connected to the control board 200.

Figure 4:
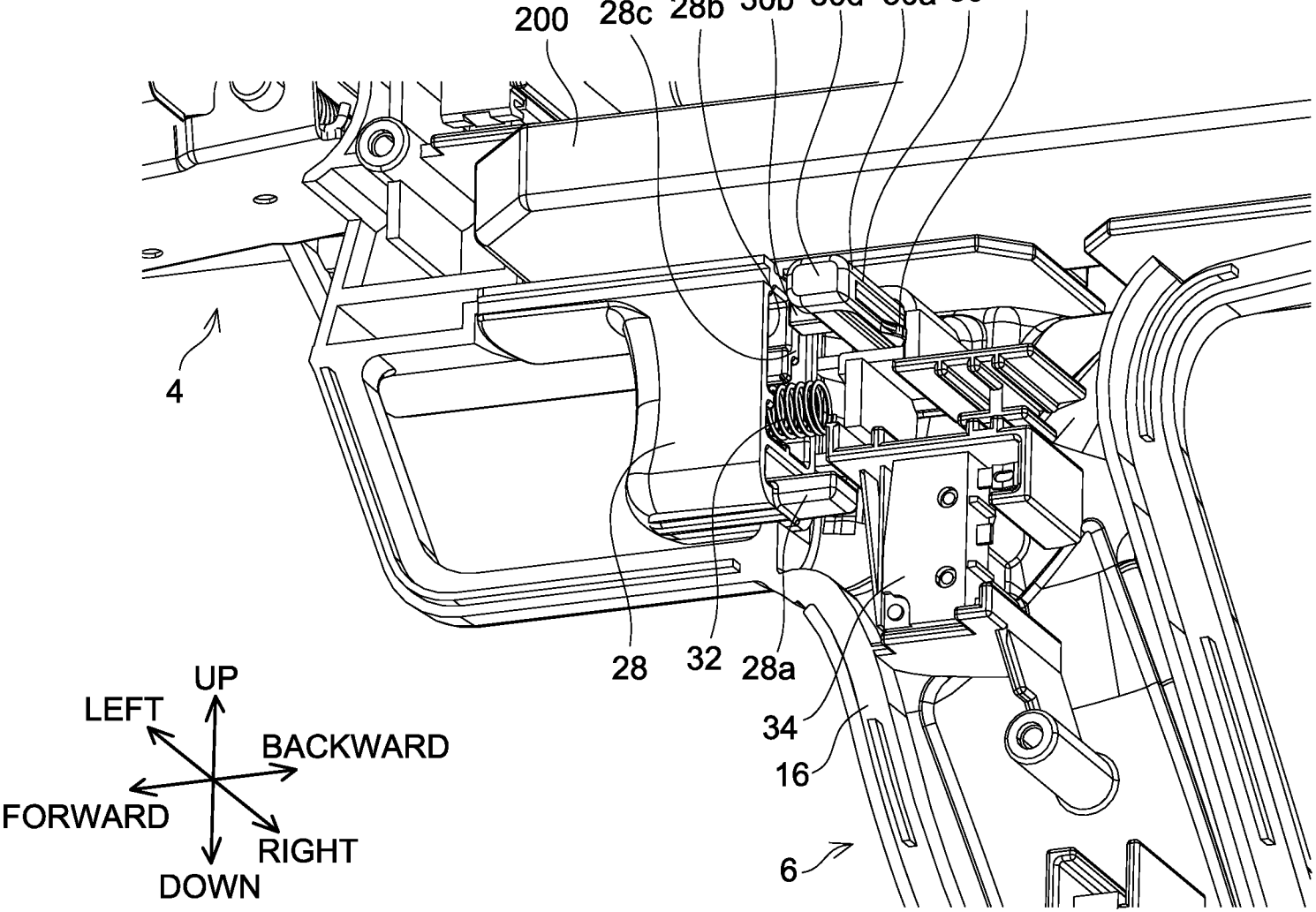
FIG. 4 is a perspective view seeing an internal structure of an upper portion of a grip 6 of the rebar tying machine 2 according to the embodiment from the lower left rear side.

At an upper front part of the grip 6, a trigger 28 which the user can manipulate to pull and a trigger lock 30 which is disposed behind the trigger 28 and is configured to switch between a state allowing the pulling manipulation on the trigger 28 and a state prohibiting the same are provided. The trigger 28 is retained by the left housing 14 and the right housing 16 so as to be slidable relative to the grip 6 in the front-and-rear direction. As shown in FIG. 4, the trigger 28 is biased forward by a compression spring 32 retained by the left housing 14 and the right housing 16. A protrusion 28*a* protruding rearward is provided at a lower rear part of the trigger 28. A trigger switch 34 is disposed at an upper part inside the grip 6. The trigger switch 34 is electrically connected to the control board 200. When the user places his/her finger on the trigger 28 and performs the pulling manipulation on the trigger 28 against biasing force of the compression spring 32, the trigger 28 moves rearward and the protrusion 28*a* presses on the trigger switch 34. When the user releases the finger from the trigger 28, the trigger 28 moves forward by the biasing force of the compression spring 32 and the protrusion 28*a* separates from the trigger switch 34.

Figure 5:
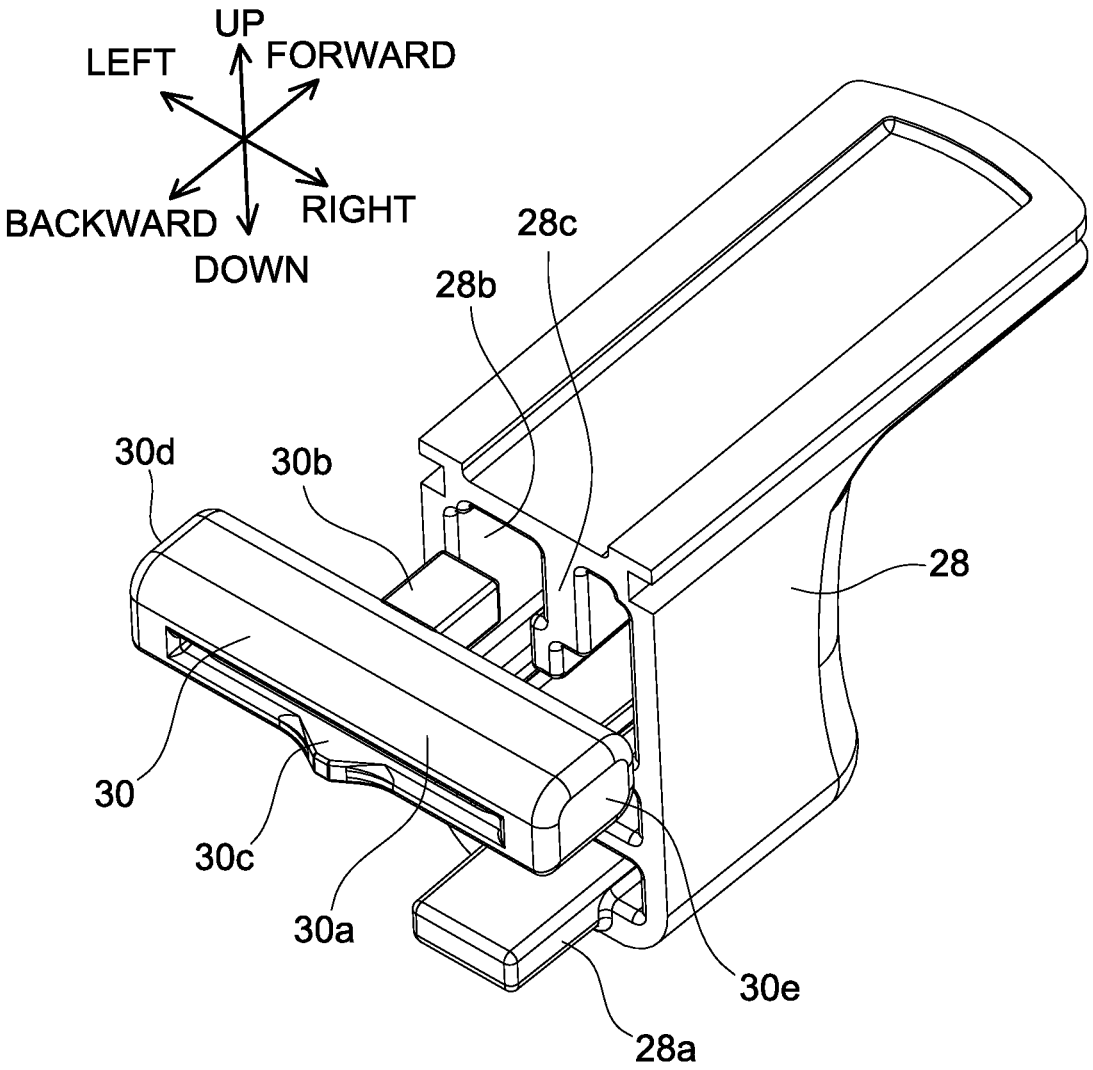
FIG. 5 is a perspective view seeing a trigger 28 and a trigger lock 30 from the upper right rear side when the trigger lock 30 is at an allowing position in the rebar tying machine 2 according to the embodiment.
Figure 6:
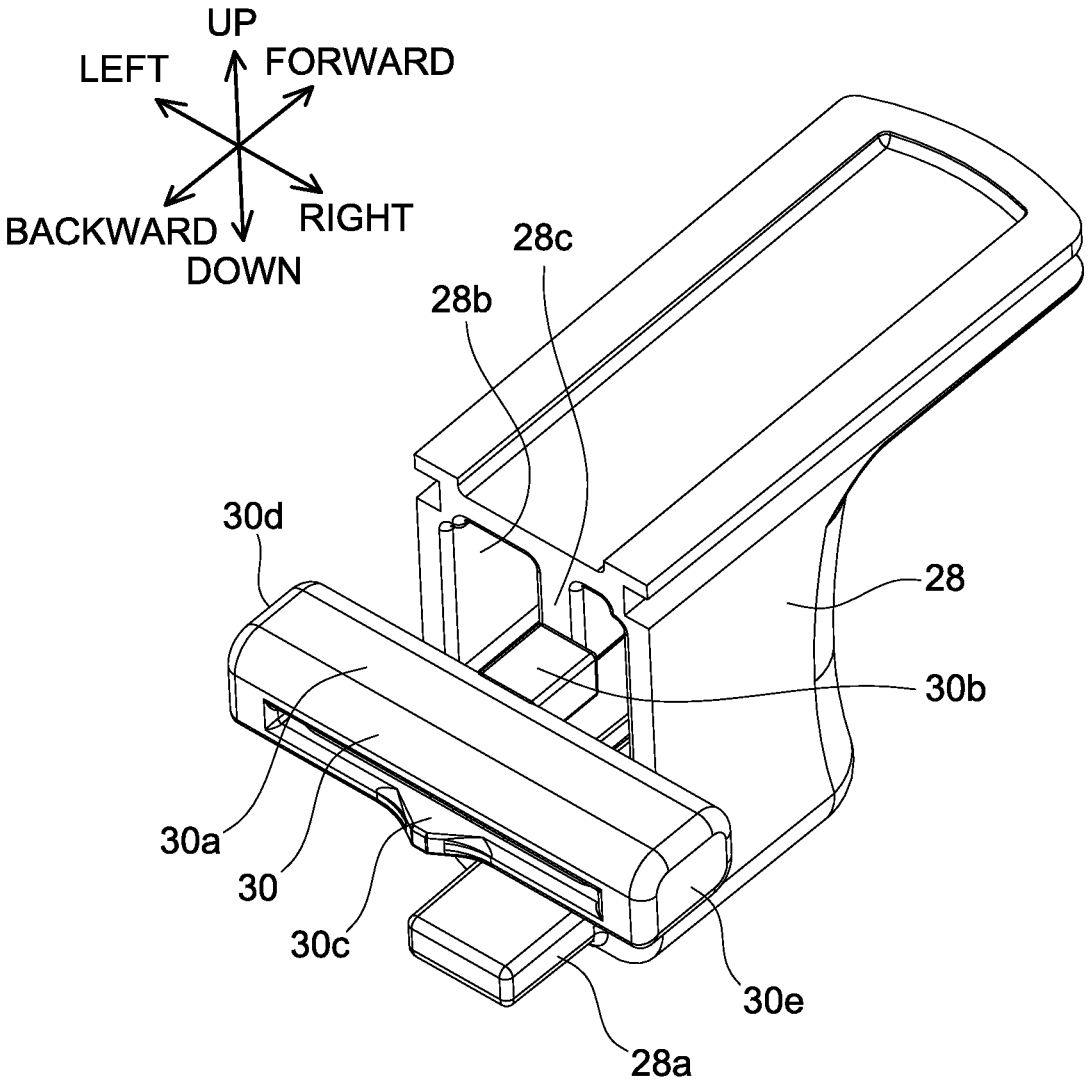
FIG. 6 is a perspective view seeing the trigger 28 and the trigger lock 30 from the upper right rear side when the trigger lock 30 is at a prohibiting position in the rebar tying machine 2 according to the embodiment.

As shown in FIGS. 5 and 6, the trigger lock 30 includes a base 30*a* extending linearly in the left-and-right direction, a protrusion 30*b* protruding forward from near a center of the base 30*a*, and an engaging portion 30*c* provided on a rear surface of the base 30*a* near the center thereof. As shown in FIGS. 1 and 2, a left end surface 30*d* and a right end surface 30*e* of the base 30*a* of the trigger lock 30 are respectively disposed so as to be exposed on a left surface and a right surface of the grip 6. The trigger lock 30 is retained by the left housing 14 and the right housing 16 so as to be slidable in the left-and-right direction relative to the grip 6. The trigger lock 30 is configured to move between an allowing position that allows the pulling manipulation on the trigger 28 and a prohibiting position that prohibits the pulling manipulation on the trigger 28. As shown in FIGS. 5 and 6, a recess 28*b* configured to receive the protrusion 30*b* and a stopper 28*c* configured to prohibit the reception of the protrusion 30*b* are provided at an upper rear part of the trigger 28. As shown in FIG. 5, when the trigger lock 30 is at the allowing position, the left end surface 30*d* of the trigger lock 30 protrudes outward than the left surface of the grip 6, and the engaging portion 30*c* is engaged with an engaged portion (not shown) provided on the left housing 14 and the right housing 16. Further, when the trigger lock 30 is at the allowing position, the protrusion 30*b* of the trigger lock 30 faces the recess 28*b* of the trigger 28. When the trigger 28 is moved rearward in this state, the protrusion 30*b* is received by the recess 28*b*, so the trigger 28 can move rearward. That is, when the trigger lock 30 is in the allowing position, the user can perform the pulling manipulation on the trigger 28. When the user pushes in the left end surface 30*d* of the trigger lock 30 from the left side of the grip 6 in the state where the trigger lock 30 is in the allowing position, the engagement of the engaging portion 30*c* of the trigger lock 30 is released, and the trigger lock 30 slides in the right direction to move to the prohibiting position. As shown in FIG. 6, when the trigger lock 30 is in the prohibiting position, the right end surface 30*e* of the trigger lock 30 protrudes outward than the right surface of the grip 6, and the engaging portion 30*c* is engaged with the engaged portion (not shown) provided on the left housing 14 and the right housing 16. Further, when the trigger lock 30 is in the prohibiting position, the protrusion 30*b* of the trigger lock 30 faces the stopper 28*c* of the trigger 28. When the trigger 28 is moved rearward in this state, the protrusion 30*b* comes to contact with the stopper 28*c*, and further rearward movement of the trigger 28 is thereby prohibited. That is, when the trigger lock 30 is in the prohibiting position, the user's pulling manipulation on the trigger 28 is prohibited. When the user pushes in the right end surface 30*e* of the trigger lock 30 from the right side of the grip 6 in the state where the trigger lock 30 is in the prohibiting position, the engagement of the engaging portion 30*c* of the trigger lock 30 is released, and the trigger lock 30 slides in the left direction to move to the allowing position. Since the rebar tying machine 2 of the present embodiment uses the slid-type trigger lock 30 as above, a mechanical configuration thereof can be simplified and the rebar tying machine 2 can be made compact as compared to a case where a rotary-type trigger lock is used.

Figure 7:
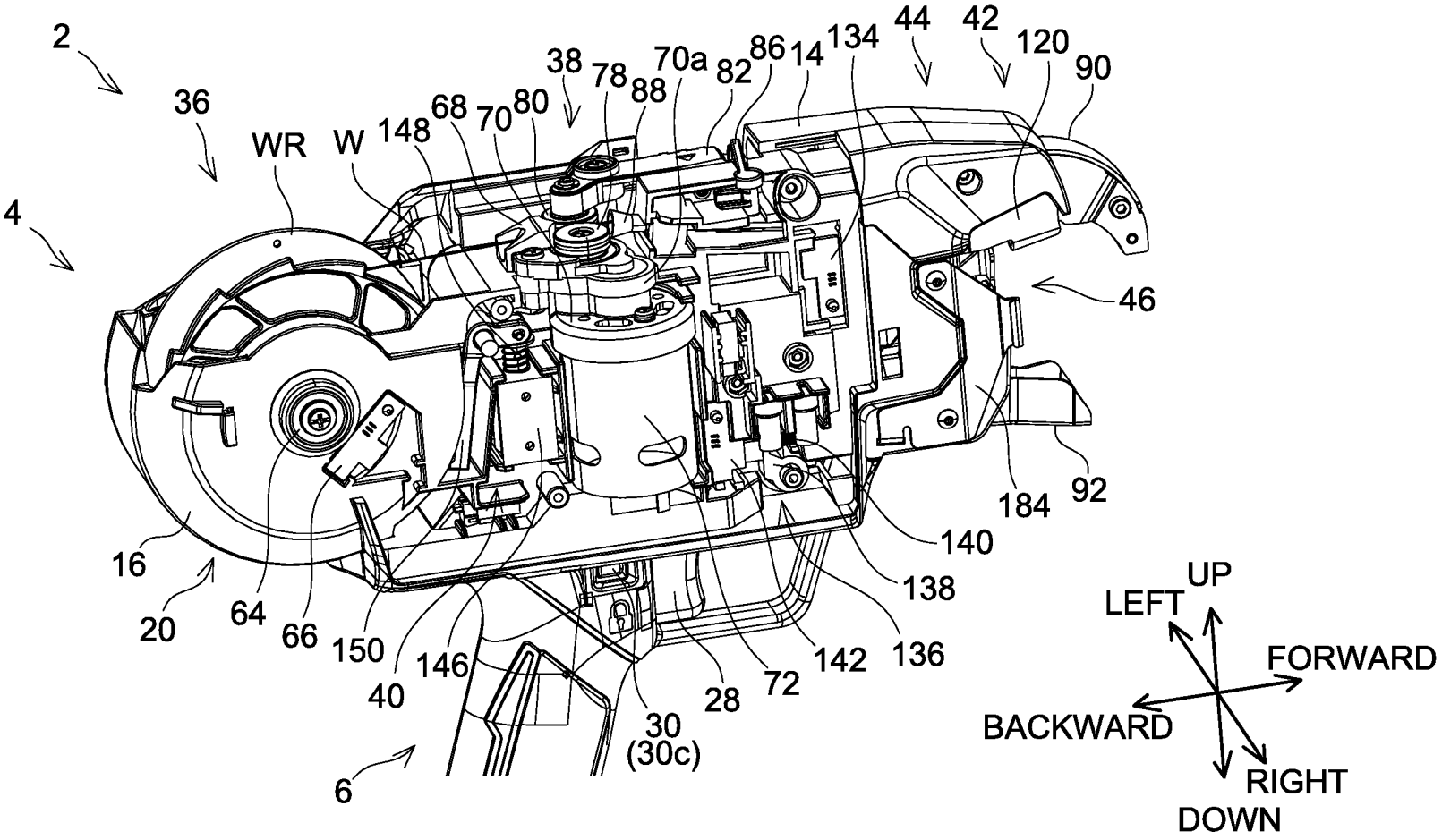
FIG. 7 is a perspective view seeing an internal structure of a tying machine body 4 of the rebar tying machine 2 according to the embodiment from the upper right rear side.
Figure 8:
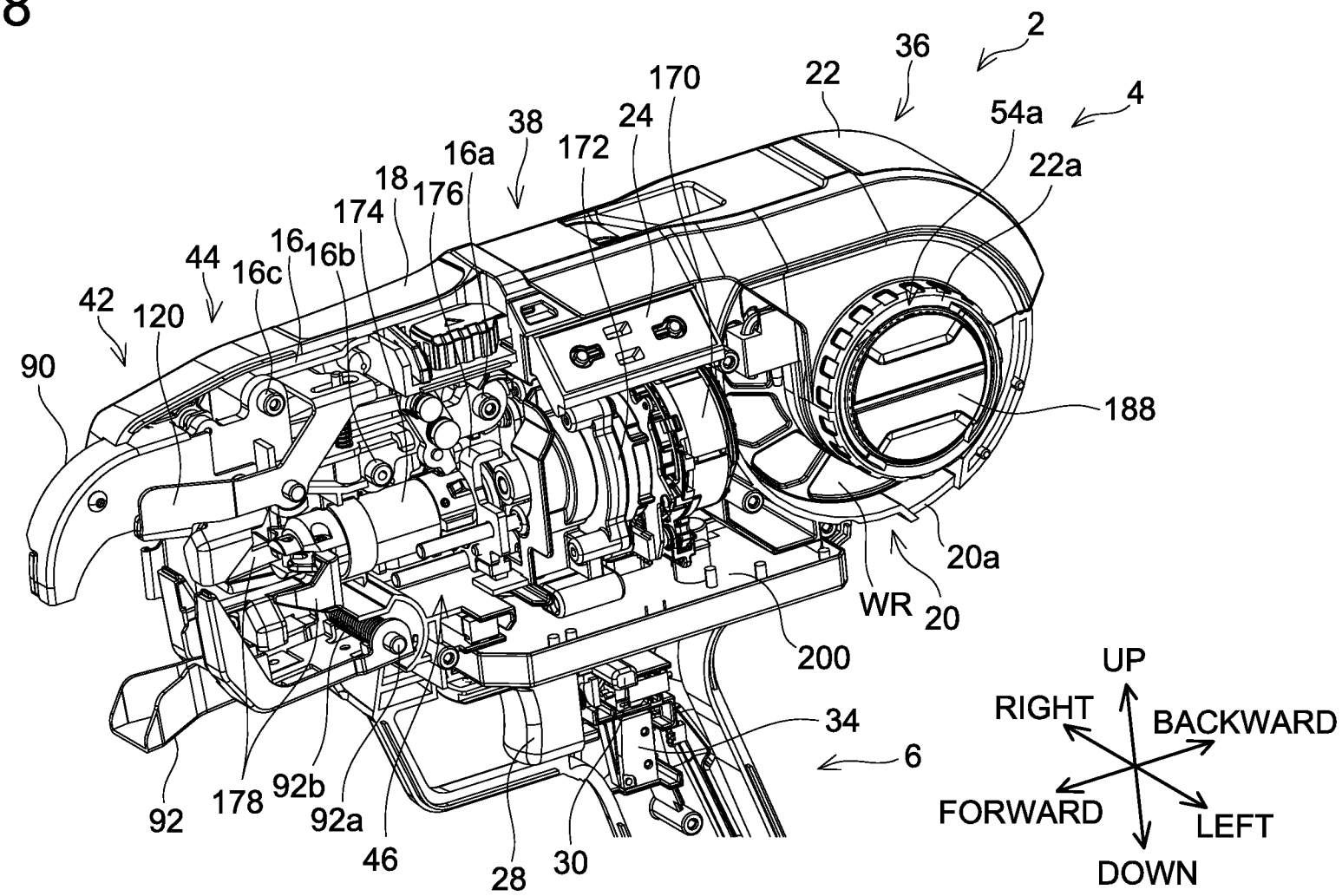
FIG. 8 is a perspective view seeing the internal structure of the tying machine body 4 of the rebar tying machine 2 according to the embodiment from an upper left front side.

As shown in FIGS. 7 and 8, the tying machine body 4 primarily includes a housing mechanism 36, a feed mechanism 38, a brake mechanism 40, a guide mechanism 42, a cutting mechanism 44, a twisting mechanism 46, and the control board 200.

As shown in FIG. 7, the housing mechanism 36 is disposed at the rear part of the tying machine body 4, and detachably retains the wire reel WR housed in the reel housing compartment 20. The wire reel WR is supported rotatably by the housing mechanism 36 in the reel housing compartment 20.

Figure 9:
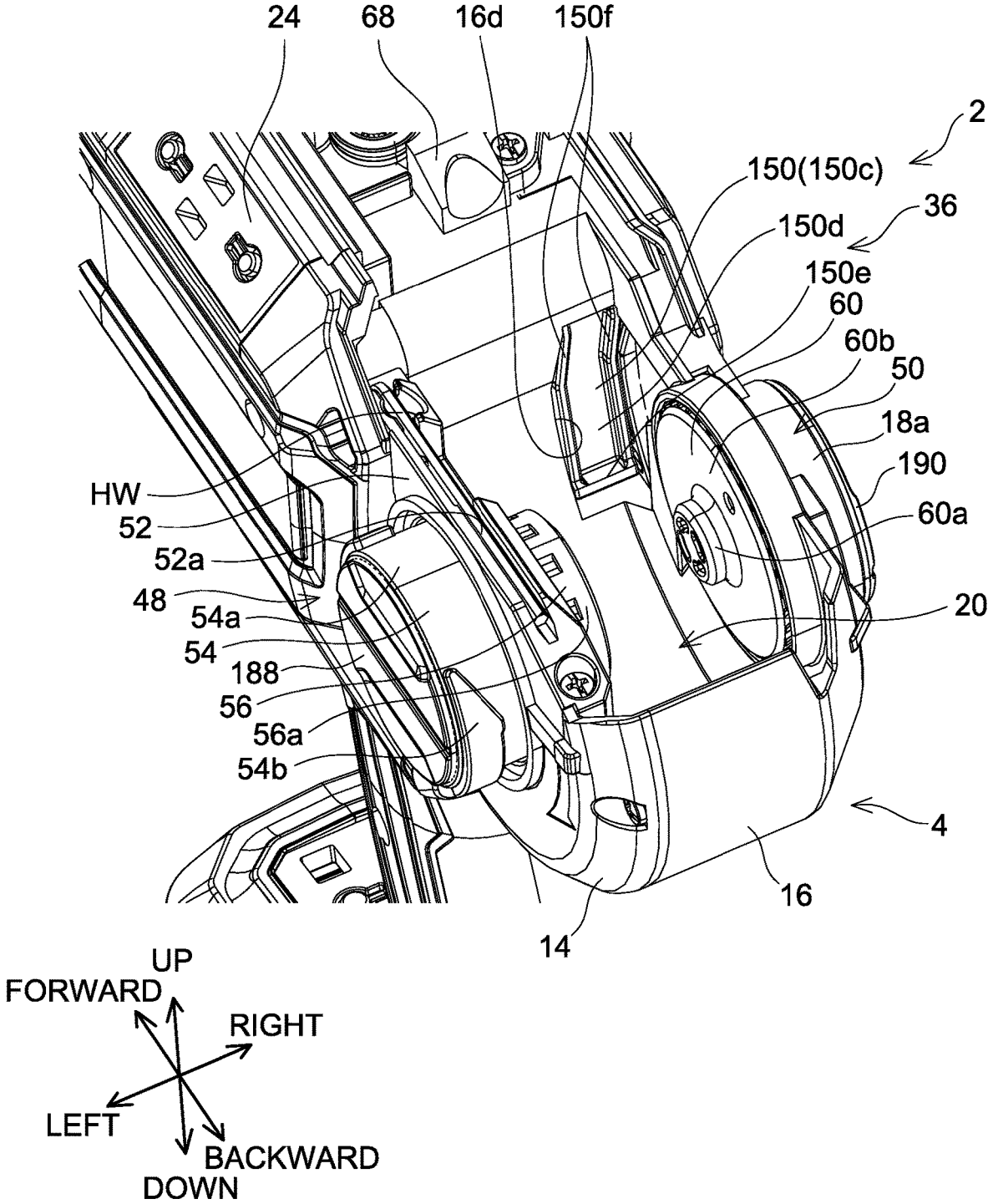
FIG. 9 is a perspective view seeing a reel housing compartment 20 of the rebar tying machine 2 according to the embodiment from the upper left rear side.
Figure 10:
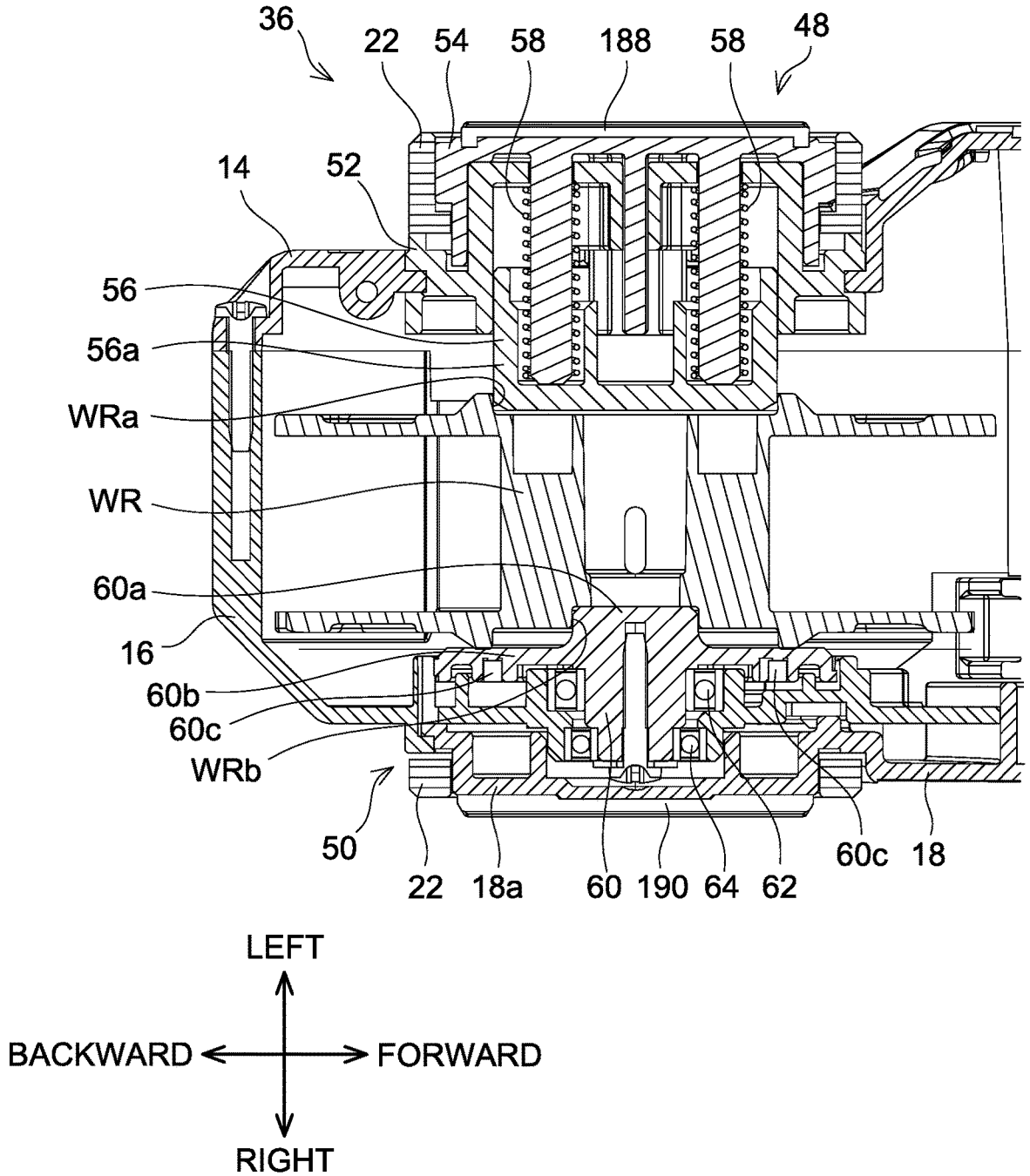
FIG. 10 is a cross-sectional view of a housing mechanism 36 of the rebar tying machine 2 according to the embodiment.

As shown in FIGS. 9 and 10, the housing mechanism 36 is provided with a left supporting mechanism 48 provided on a left side of the reel housing compartment 20 and a right supporting mechanism 50 provided on a right side of the reel housing compartment 20.

As shown in FIG. 10, the left supporting mechanism 48 includes a base member 52, a cam member 54, a shaft member 56, and a compression spring 58. The base member 52 is fixed to the left housing 14 with a plurality of screws. As shown in FIG. 9, an upper surface of the base member 52 is provided with a tool groove 52*a* configured to accept a tool that the user uses to perform maintenance on the rebar tying machine 2, such as a hexagonal wrench HW. As shown in FIG. 10, the cam member 54 is disposed to penetrate through the base member 52, and is retained by the base member 52 so as to be slidable in the left-and-right direction. The cam member 54 includes a cylindrical cover retainer 54*a* protruding outside the reel housing compartment 20. The cover retainer 54*a* retains the attaching portion 22*a* of the reel cover 22. The attaching portion 22*b* of the reel cover 22 is retained by a cylindrical cover retainer 18*a* provided on the side-surface cover housing 18. As shown in FIG. 9, a cam protrusion 54*b* is provided on an outer circumferential surface of the cover retainer 54*a*. Corresponding to the cam protrusion 54*b* of the cover retainer 54*a*, a cam protrusion, which is not shown, is provided on an inner circumferential surface of the attaching portion 22*a* of the reel cover 22. As shown in FIG. 10, the shaft member 56 includes a cylindrical reel retainer 56*a* protruding toward inside of the reel housing compartment 20. The shaft member 56 is fixed to the cam member 54 with a plurality of screws. Due to this, the shaft member 56 is slidable, together with the cam member 54, relative to the base member 52 in the left-and-right direction. Further, the shaft member 56 is biased in the right direction (that is, toward inside of the reel housing compartment 20) by the compression spring 58 retained by the base member 52. Under a normal state, the cam member 54 and the shaft member 56 are moved to the right side (that is, toward inside of the reel housing compartment 20) relative to the base member 52 by biasing force of the compression spring 58. In this state, the reel retainer 56*a* enters a shaft receiving groove WRa of the wire reel WR and the cam protrusion 54*b* of the cam member 54 presses the cam protrusion of the attaching portion 22*a* in a direction closing the reel cover 22, by which the reel cover 22 is closed. In this state, since the reel retainer 56*a* enters the shaft receiving groove WRa so as to be slidable relative to the shaft receiving groove WRa, the wire reel WR is retained rotatable relative to the reel retainer 56*a*. When the user opens the reel cover 22 against the biasing force of the compression spring 58 in this state, the cam protrusion of the attaching portion 22*a* of the reel cover 22 pushes the cam protrusion 54*b* of the cover retainer 54*a* in the left direction (that is, toward outside of the reel housing compartment 20) as the reel cover 22 rotates. Due to this, the cam member 54 and the shaft member 56 move to the left side (that is, toward outside of the reel housing compartment 20) relative to the base member 52, and the reel retainer 56*a* slides out of the shaft receiving groove WRa of the wire reel WR. In this state, the user can take out or put in the wire reel WR from or into the reel housing compartment 20.

Figure 11:
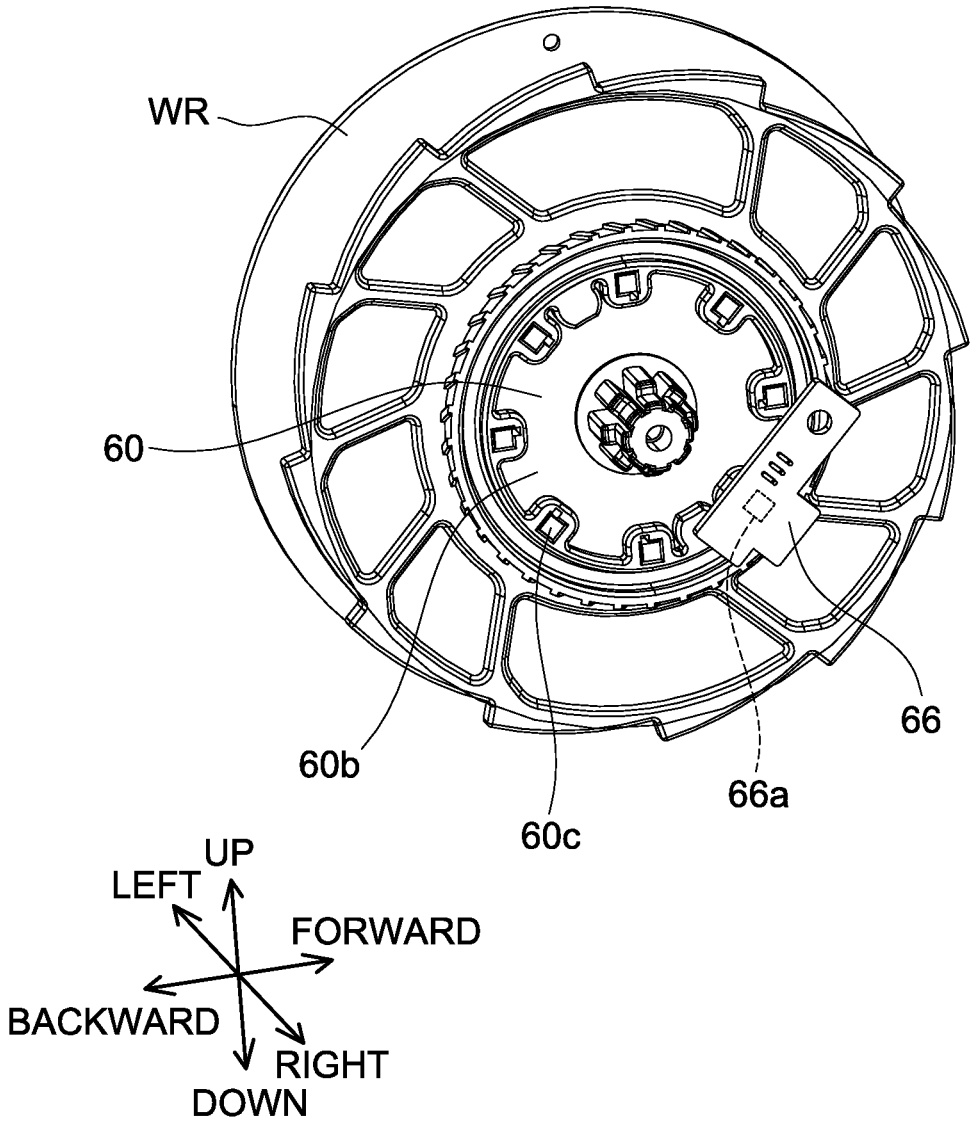
FIG. 11 is a perspective view seeing a wire reel WR, a turntable 60, and a magnetic sensor 66 of the rebar tying machine 2 according to the embodiment from the upper right rear side.
Figure 33:
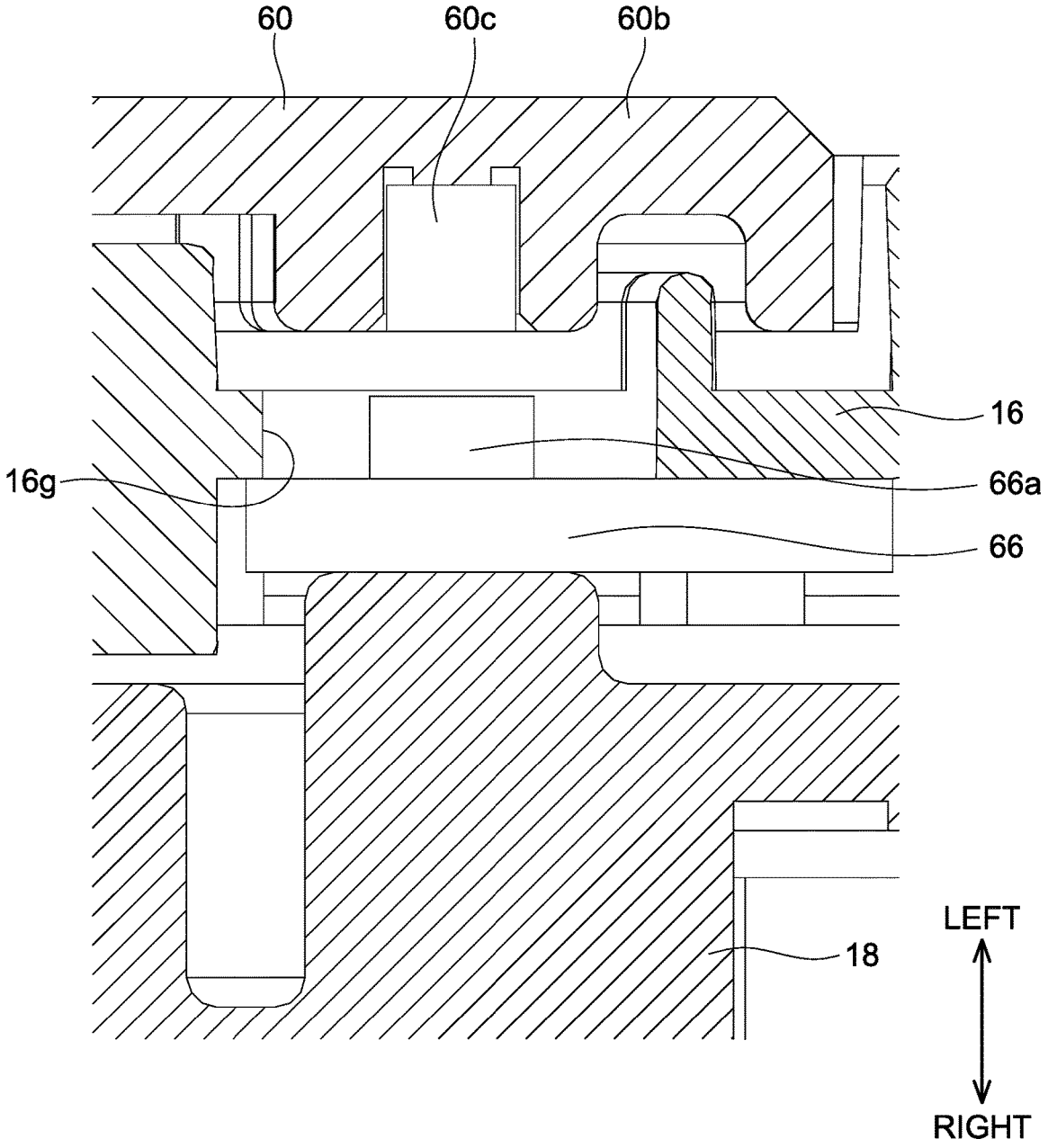
FIG. 33 is a cross-sectional view of the right housing 16, a side-surface cover housing 18, the turntable 60, and the magnetic sensor 66 of the rebar tying machine 2 according to the embodiment along a line XXXIII-XXXIII in FIG. 29.

As shown in FIG. 10, the right supporting mechanism 50 includes a turntable 60, an inner bearing 62, an outer bearing 64, and a magnetic sensor 66 (see FIG. 7). The turntable 60 is rotatably retained by the right housing 16 via the inner bearing 62 and the outer bearing 64. The turntable 60 includes a cylindrical reel retainer 60*a* protruding toward inside of the reel housing compartment 20 and a disk-shaped rotation detector 60*b* disposed along an inner side surface of the reel housing compartment 20. The reel retainer 60*a* engages with a shaft receiving groove WRb of the wire reel WR so as to be incapable of rotating relative thereto. Thus, when the wire reel WR rotates, the turntable 60 rotates together with the wire reel WR. As shown in FIG. 11, the rotation detector 60*b* has a plurality of magnets 60*c* attached thereto at predetermined angle intervals. As shown in FIG. 7, the magnetic sensor 66 is disposed outside the right housing 16. The magnetic sensor 66 is electrically connected to the control board 200. As shown in FIGS. 29, 30, 31 and 32, the magnetic sensor 66 includes a Hall IC 66*a* and a through hole 66*b*. The right housing 16 includes a pin 16*e* protruding in a column shape from an outer surface of the right housing 16 at a position corresponding to the through hole 66*b* of the magnetic sensor 66, and a pair of interposing walls 16*f* disposed to interpose the magnetic sensor 66 therebetween with an interval smaller than a width of the magnetic sensor 66, and a through hole 16*g* provided at a position corresponding to the Hall IC 66*a* of the magnetic sensor 66. The magnetic sensor 66 is fitted to the right housing 16 by inserting the pin 16*e* of the right housing 16 into the through hole 66*b* and press-fitting the magnetic sensor 66 between the pair of interposing walls 16*f* of the right housing 16. In a state where the magnetic sensor 66 is attached to the right housing 16, the magnetic sensor 66 is disposed such that the Hall IC 66*a* faces one of the magnets 60*c* through the through hole 16*g* of the right housing 16. As shown in FIG. 33, in a state where the side-surface cover housing 18 is attached to the right housing 16, the magnetic sensor 66 is interposed between the right housing 16 and the side-surface cover housing 18. When the wire reel WR rotates, the magnets 60*c* of the turntable 60 rotate together with the wire reel WR, and magnetics detected by the Hall IC 66*a* thereby change. The control board 200 is configured to detect the rotation of the wire reel WR from the changes in the magnetics of the magnets 60*c* detected by the Hall IC 66*a* of the magnetic sensor 66. In the rebar tying machine 2 of the present embodiment, the magnetic sensor 66 is attached to the right housing 16 that rotatably retains the turntable 60 via the inner bearing 62 and the outer bearing 64. With such a configuration, the magnets 60*c* attached to the turntable 60 and the magnet sensor 66 can be positioned accurately.

Figure 12:
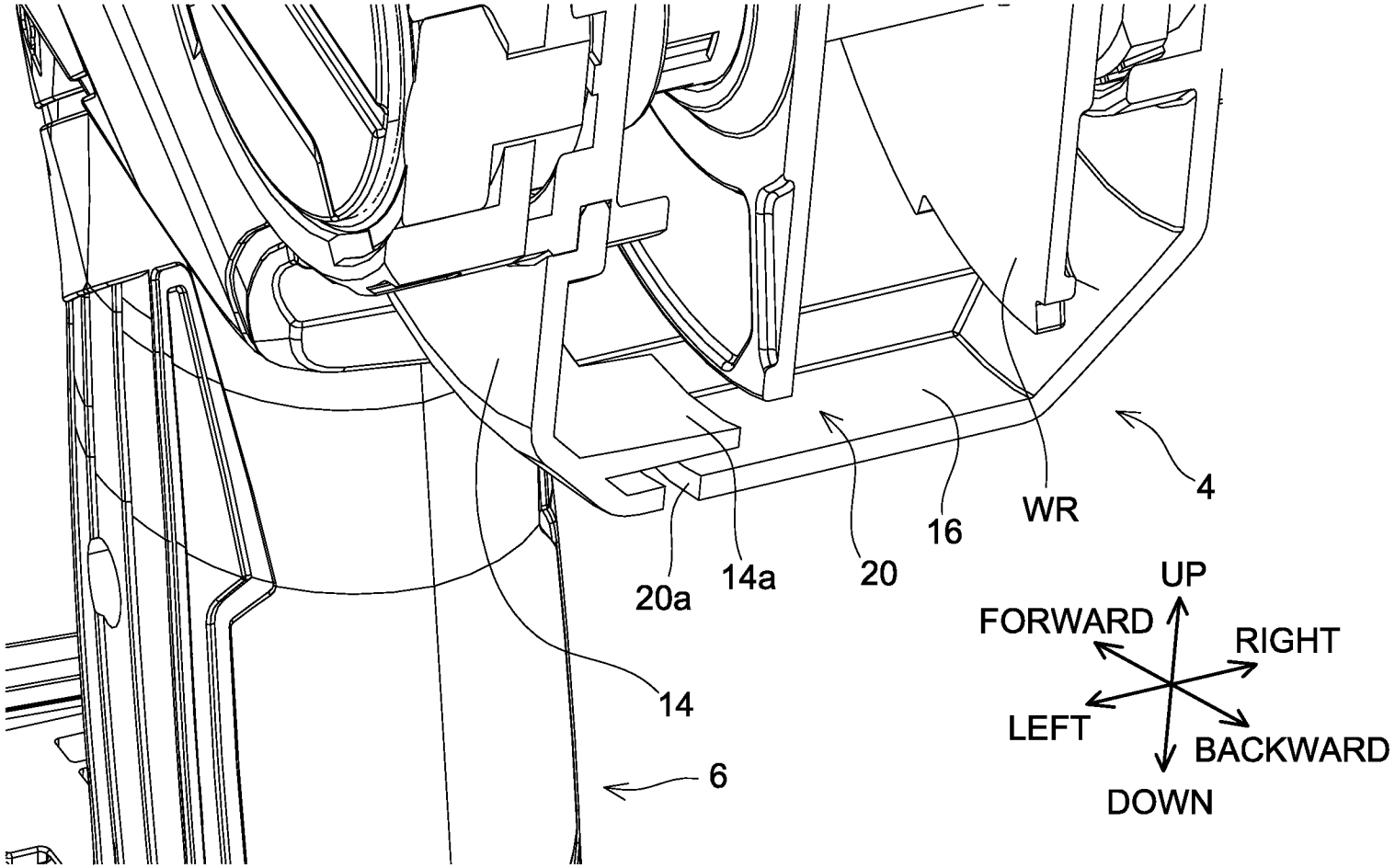
FIG. 12 is a perspective view seeing the reel housing compartment 20 of the rebar tying machine 2 according to the embodiment from the upper left rear side, and shows a vicinity of a water drainage hole 20*a* in cross section.

As shown in FIG. 3, a water drainage hole 20*a* is provided at a lowermost part of the reel housing compartment 20. With the water drainage hole 20*a* provided, water can be discharged to outside from inside of the reel housing compartment 20 even when water enters inside the reel housing compartment 20. The water drainage hole 20*a* is disposed at a position through which the inside of the reel housing compartment 20 cannot be seen in the rear view of the rebar tying machine 2. Thus, the rotating wire reel WR is not exposed to a body of the user who stands behind the rebar tying machine 2, by which safety for the user can be ensured. Further, as shown in FIG. 12, the water drainage hole 20*a* has a so-called labyrinth structure in which the inside of the reel housing compartment 20 cannot be seen from the outside due to a partition wall 14*a* provided on the left housing 14. With such a configuration, foreign matters can be suppressed from entering inside the reel housing compartment 20 through the water drainage hole 20*a*.

Figure 13:
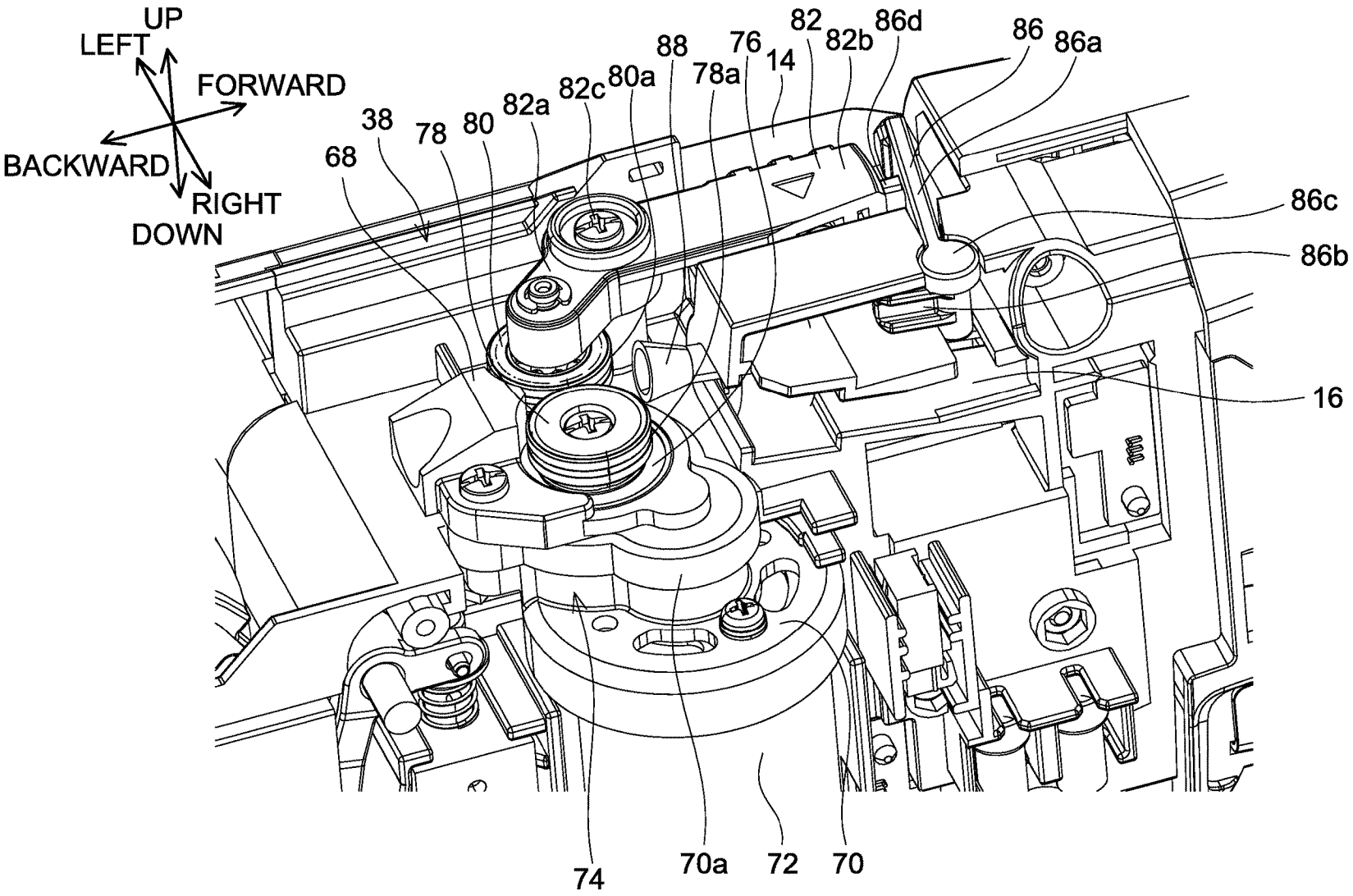
FIG. 13 is a perspective view seeing a feed mechanism 38 of the rebar tying machine 2 according to the embodiment from the upper right rear side.
Figure 14:
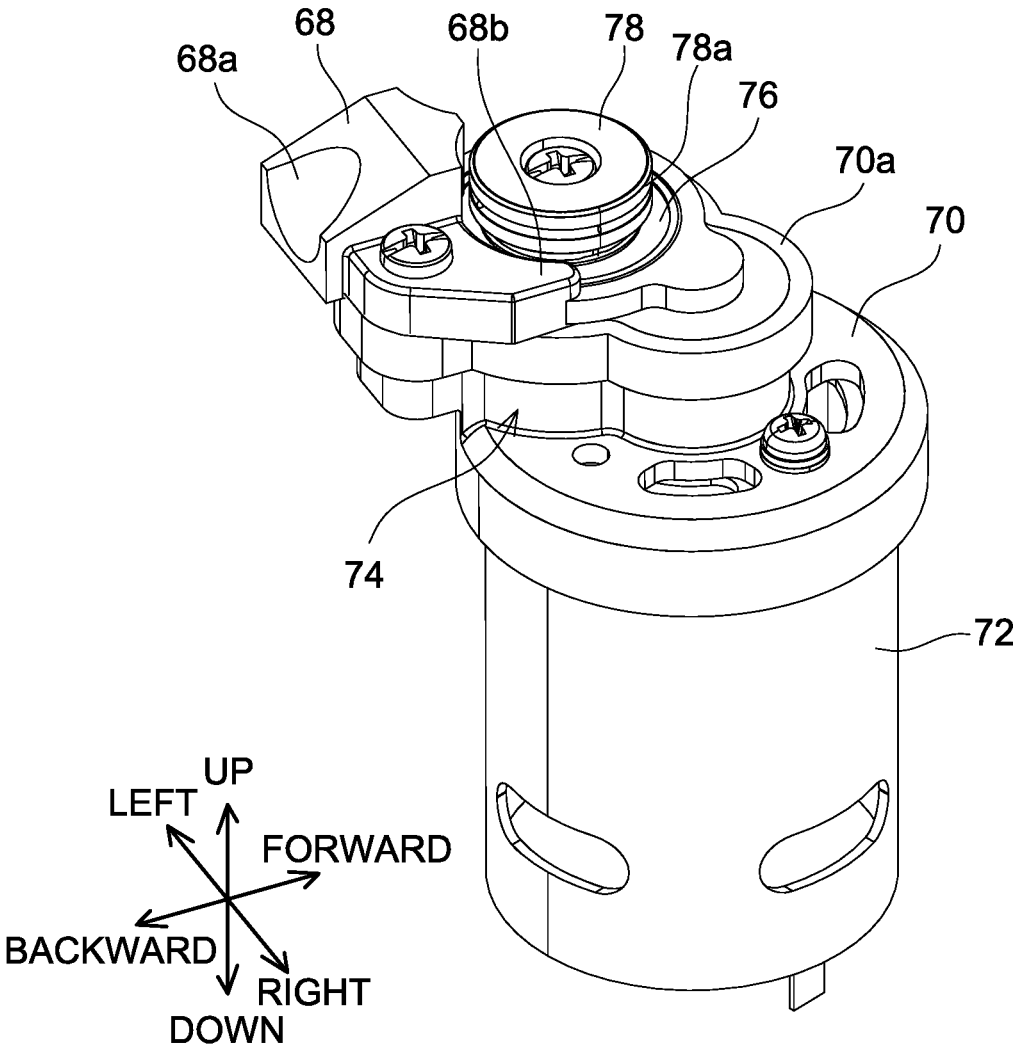
FIG. 14 is a perspective view seeing a guide member 68, a cover member 70, a feed motor 72, a reduction mechanism 74, a bearing 76, and a drive gear 78 of the rebar tying machine 2 according to the embodiment from the upper right rear side.
Figure 15:
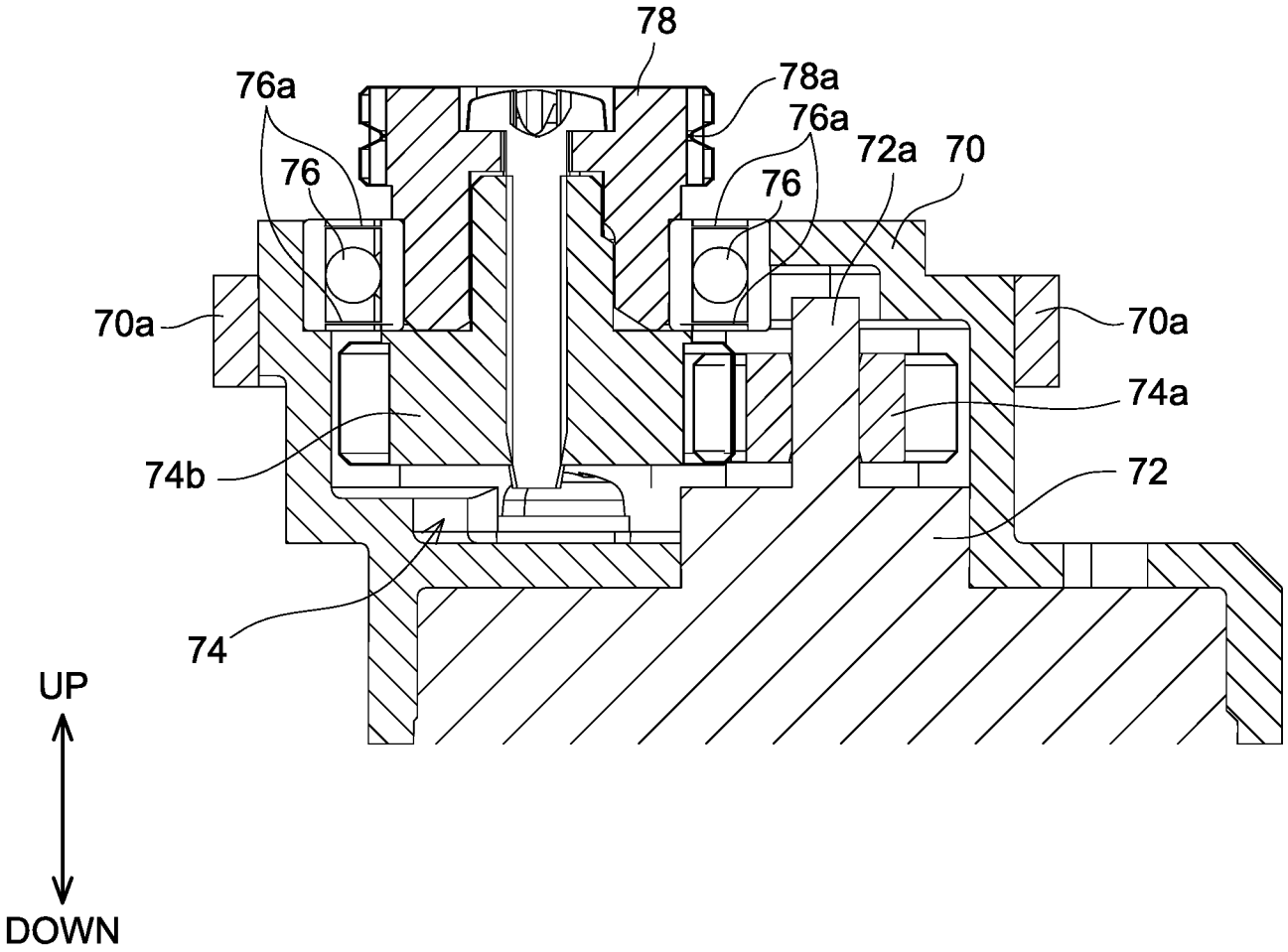
FIG. 15 is a cross-sectional view of the cover member 70, the feed motor 72, the reduction mechanism 74, the bearing 76, and the drive gear 78 of the rebar tying machine 2 according to the embodiment.

As shown in FIG. 7, the feed mechanism 38 is disposed at an upper part of the tying machine body 4 near its center in the front-and-rear direction, and is configured to feed out the wire W supplied from the wire reel WR of the housing mechanism 36 to the guide mechanism 42 at a front part of the tying machine body 4. As shown in FIG. 13, the feed mechanism 38 is provided with a guide member 68, a cover member 70, a feed motor 72, a reduction mechanism 74, a bearing 76, a drive gear 78, a driven gear 80, a release lever 82, a compression spring 84 (see FIG. 17), and a lock lever 86. As shown in FIGS. 14 and 15, the cover member 70, the feed motor 72, the reduction mechanism 74, the bearing 76, and the drive gear 78 are configured as a unit, and the unit is attached to the right housing 16 and the side-surface cover housing 18 in a state where the guide member 68 is further fixed to the cover member 70 by a screw. The cover member 70 is interposed between the right housing 16 and the side-surface cover housing 18 via a cushion member 70*a*. Thus, dust and the like are suppressed from moving through a gap between the cover member 70 and the right housing 16 and a gap between the cover member 70 and the side-surface cover housing 18.

As shown in FIG. 15, a side surface of the drive gear 78 is provided with a V-shaped groove 78*a* extending in a circumferential direction of the drive gear 78 at its height-wise center. As described later, the drive gear 78 functions as a feed roller configured to feed the wire W. The drive gear 78 is coupled to the feed motor 72 via the reduction mechanism 74. The feed motor 72 is a direct current brush motor. The feed motor 72 is electrically connected to the control board 200. The control board 200 is configured to control an operation of the feed motor 72. The reduction mechanism 74 is provided with a pair of a spur gear 74*a* and a spur gear 74*b*. The spur gear 74*a* is fixed to an output shaft 72*a* of the feed motor 72. The spur gear 74*b* is fixed to the drive gear 78 by a screw. The cover member 70 is provided with a through hole through which the spur gear 74*b* and the drive gear 78 penetrate. The spur gear 74*b* and the drive gear 78 configure a rotation transmission mechanism configured to transmit rotation of the feed motor 72 to the drive gear 78 via the through hole of the cover member 70. The drive gear 78 is retained rotatably by the cover member 70 via the bearing 76. The bearing 76 is a dust-proof bearing, and is provided with a dust cover 76*a* that prevents dust from entering inside the bearing 76. The dust cover 76*a* may be a member integrated with the bearing 76, or may be a member separate from the bearing 76. The reduction mechanism 74 is housed in a space inside the cover member 70. That is, the reduction mechanism 74 is disposed on a feed motor 72 side as seen from the cover member 70, and is configured to reduce the rotation of the feed motor 72 and transmit the same to the drive gear 78. In the rebar tying machine 2, when the drive gear 78 feeds out the wire W, dust may occur due to wear of the wire W and/or the drive gear 78. If this dust reaches the feed motor 72 and the reduction mechanism 74, it may adversely affect operations of the feed motor 72 and the reduction mechanism 74. According to the rebar tying machine 2 of the present embodiment, the bearing 76 attached in the through hole of the cover member 70 functions as a suppressing member that suppresses the dust from moving to the feed motor 72 side from a drive gear 78 side through the through hole. Due to this, the dust can be prevented from adversely affecting the feed motor 72 and the reduction mechanism 74.

Figure 16:
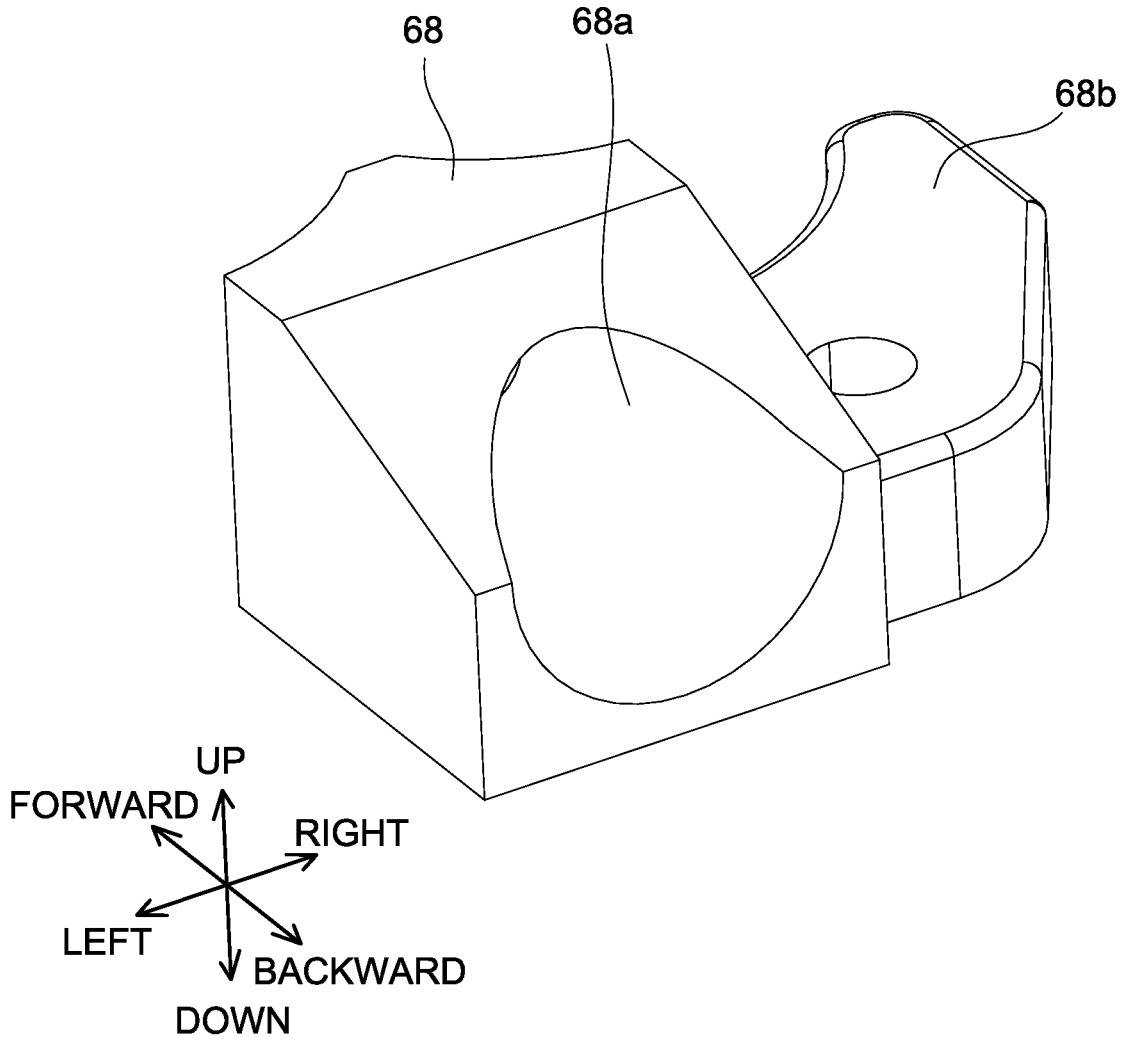
FIG. 16 is a perspective view seeing the guide member 68 of the rebar tying machine 2 according to the embodiment from the upper left rear side.

As shown in FIG. 16, the guide member 68 is provided with an insertion hole 68*a* for guiding the wire W drawn out from the wire reel WR toward the drive gear 78 and the driven gear 80. The insertion hole 68*a* has a shape in which a cone having a large diameter on an inlet side and a small diameter on an outlet side is cut obliquely. Due to this, an inlet of the insertion hole 68*a* of the guide member 68 opens to both upper and rear sides. Since the inlet of the insertion hole 68*a* is open to the upper side, that is, the inlet of the insertion hole 68*a* is open to an opposite side from a cover member 70 side as seen from the guide member 68, when the user of the rebar tying machine 2 inserts the wire W drawn out from the wire reel WR to the insertion hole 68*a*, a tip end of the wire W can easily be inserted to the insertion hole 68*a*. Further, a stopper piece 68*b* is provided on the guide member 68. As shown in FIG. 14, when the guide member 68 is fixed to the cover member 70 by a screw, the stopper piece 68*b* of the guide member 68 is disposed to partially cover an upper surface of the bearing 76. By providing the stopper piece 68*b* on the guide member 68, the guide member 68 can be used as a stopper for preventing the bearing 76 from being detached from the cover member 70.

Figure 17:
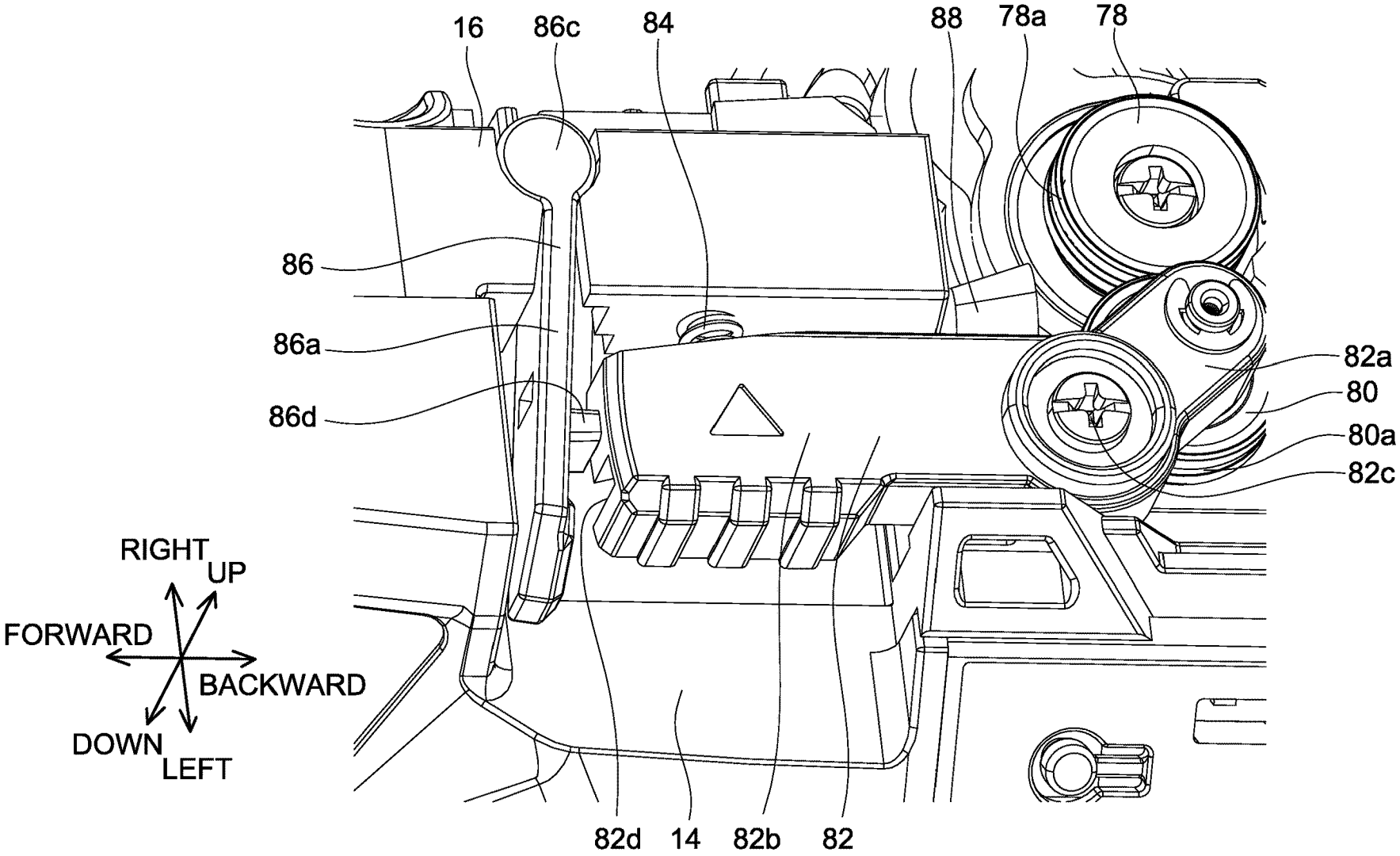
FIG. 17 is a perspective view seeing a release lever 82 and a lock lever 86 of the rebar tying machine 2 according to the embodiment from the upper left front side.

As shown in FIG. 13, the driven gear 80 is rotatably supported by a gear arm 82*a* of the release lever 82. A side surface of the driven gear 80 is provided with a V-shaped groove 80*a* extending in a circumferential direction of the driven gear 80 at its heightwise center. The release lever 82 is a substantially L-shaped member provided with a gear arm 82*a* and a manipulation arm 82*b*. The release lever 82 is pivotably supported by the right housing 16 via a pivot shaft 82*c*. As shown in FIG. 17, the manipulation arm 82*b* of the release lever 82 is biased in the left direction, that is, outward by the compression spring 84 retained by the right housing 16. Under the normal state, torque in a direction bringing the driven gear 80 closer to the drive gear 78 is applied to the release lever 82 by biasing force of the compression spring 84, by which the driven gear 80 is pressed against the drive gear 78. Due to this, teeth on the side surface of the driven gear 80 and teeth on the side surface of the drive gear 78 mesh, and the wire W is interposed between the V-shaped groove 78*a* of the drive gear 78 and the V-shaped groove 80*a* of the driven gear 80. When the drive gear 78 is rotated by the feed motor 72 in this state, the driven gear 80 rotates in a reverse direction, the wire W interposed between the drive gear 78 and the driven gear 80 is fed out to the guide mechanism 42, and the wire W is drawn out from the wire reel WR.

As shown in FIG. 13, the lock lever 86 is a substantially L-shaped member provided with a lock arm 86*a* and a spring receiver arm 86*b*. The lock lever 86 is pivotably supported by the right housing 16 via a pivot shaft 86*c*. The spring receiver arm 86*b* of the lock lever 86 is biased in the right direction by a compression spring, which is not shown, retained by the right housing 16. By biasing force of this compression spring, torque in a direction bringing the lock arm 86*a* closer to the manipulation arm 82*b* of the release lever 82 is applied to the lock lever 86. As shown in FIG. 17, the lock arm 86*a* of the lock lever 86 is provided with an engaging protrusion 86*d*, and the manipulation arm 82*b* of the release lever 82 is provided with an engaging recess 82*d* configured to engage with the engaging protrusion 86*d*.

When the user of the rebar tying machine 2 pushes in the manipulation arm 82*b* against the biasing force of the compression spring 84, the release lever 82 pivots about the pivot shaft 82*c*, and the driven gear 80 separates away from the drive gear 78. At this occasion, when the manipulation arm 82*b* is pushed in to a position where the engaging recess 82*d* of the manipulation arm 82*b* faces the engaging protrusion 86*d* of the lock arm 86*a*, the lock lever 86 pivots about the pivot shaft 86*c*, and the engaging protrusion 86*d* of the lock arm 86*a* engages with the engaging recess 82*d* of the manipulation arm 82*b*. Due to this, the manipulation arm 82*b* is maintained in a state of being pushed in. When the wire W extending from the wire reel WR is to be set in the feed mechanism 38, the user pushes in the manipulation arm 82*b* to separate the driven gear 80 away from the drive gear 78, and places, in this state, the tip end of the wire W drawn out from the wire reel WR between the dive gear 78 and the driven gear 80 through the insertion hole 68*a* of the guide member 68. Further, when the user moves the lock arm 86*a* of the lock lever 86 in a direction separating away from the manipulation arm 82*b* against the biasing force of the compression spring, the engagement between the engaging protrusion 86*d* of the lock arm 86*a* and the engaging recess 82*d* of the manipulation arm 82*b* is released and the release lever 82 pivots about the pivot shaft 82*c* by the biasing force of the compression spring 84, by which the driven gear 80 engages with the drive gear 78 and the wire W is interposed between the V-shaped groove 78*a* of the drive gear 78 and the V-shaped groove 80*a* of the driven gear 80.

Figure 20:
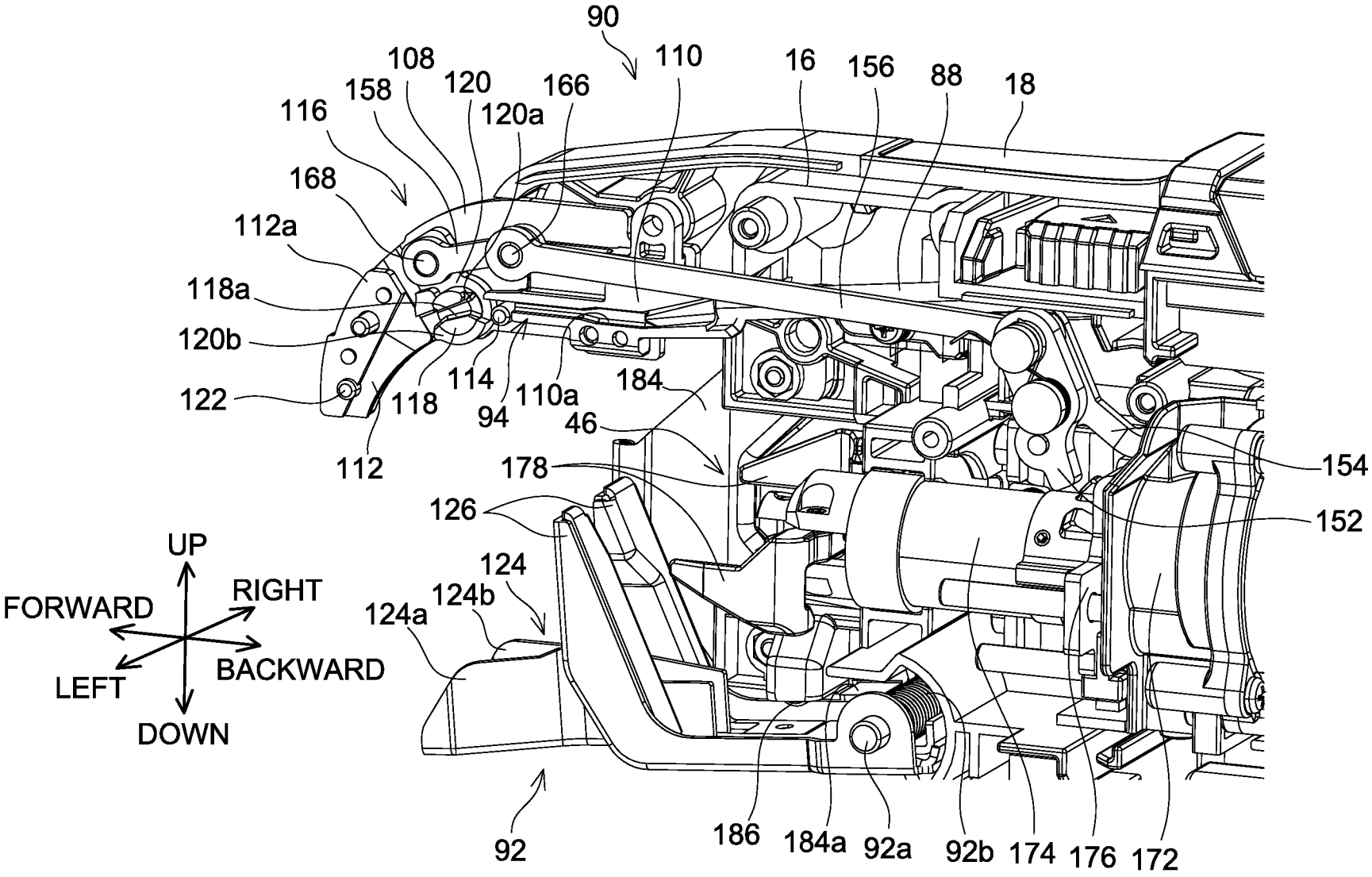
FIG. 20 is a perspective view seeing an internal structure of a first guiding passage 94 of the upper curl guide 90 and the internal structure of the tying machine body 4 of the rebar tying machine 2 according to the embodiment from the upper left rear side.

As shown in FIG. 8, the guide mechanism 42 is disposed at the front part of the tying machine body 4, and is configured to guide the wire W fed from the feed mechanism 38 in a loop shape around the plurality of rebars R (see FIG. 1). As shown in FIGS. 7 and 8, the guide mechanism 42 is provided with a guide pipe 88, an upper curl guide 90, and a lower curl guide 92. As shown in FIG. 13, a rear-side end of the guide pipe 88 is open toward a space between the drive gear 78 and the driven gear 80 of the feed mechanism 38. The wire W fed from the feed mechanism 38 is fed into the guide pipe 88. As shown in FIG. 20, a front-side end of the guide pipe 88 is open toward an inside of the upper curl guide 90. The upper curl guide 90 is provided with a first guiding passage 94 (see FIG. 20) for guiding the wire W fed from the guide pipe 88 and a second guiding passage 96 (see FIG. 21) for guiding the wire W fed from the lower curl guide 92.

Figure 18:
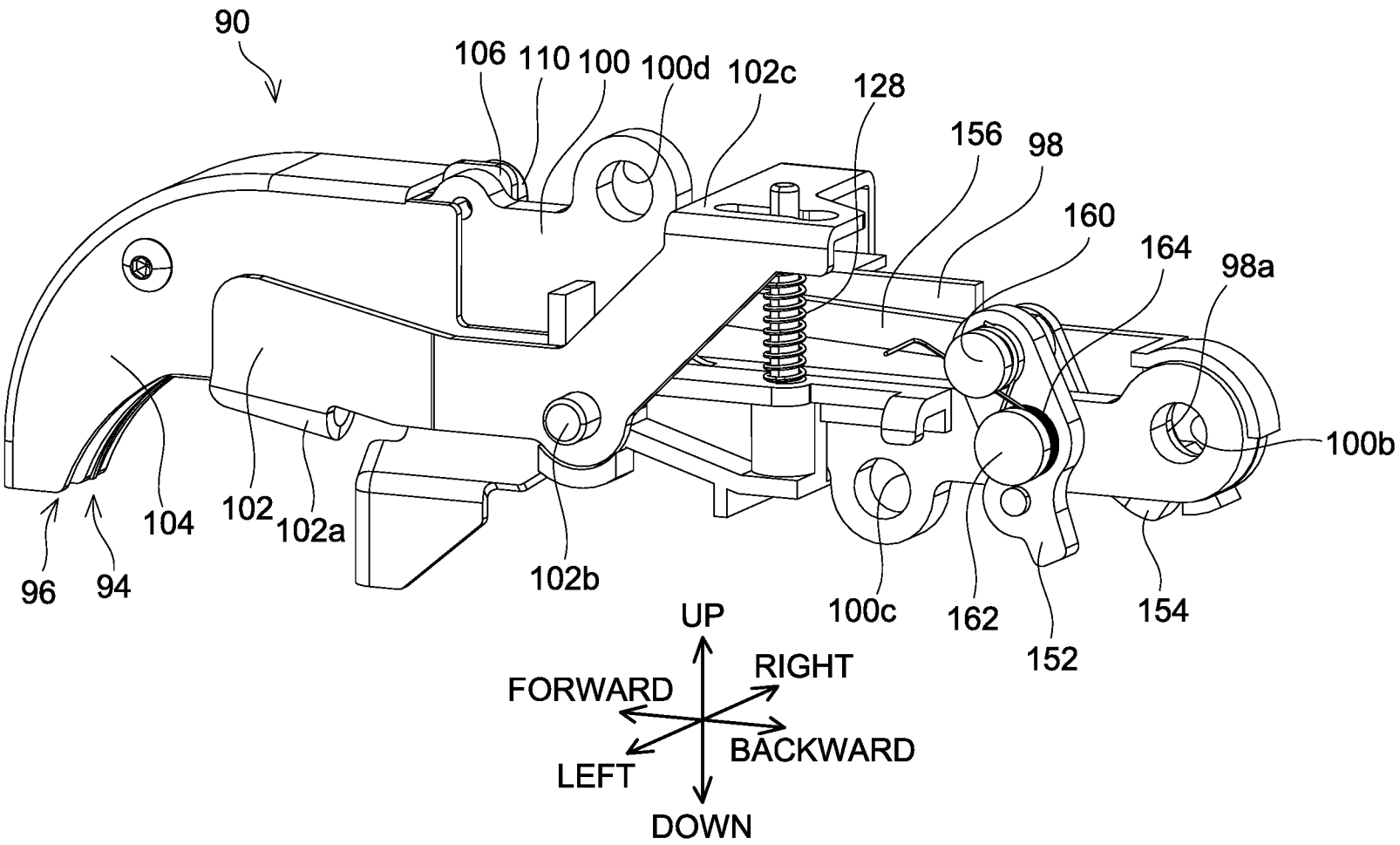
FIG. 18 is a perspective view seeing an upper curl guide 90 of the rebar tying machine 2 according to the embodiment from the upper left rear side.
Figure 19:
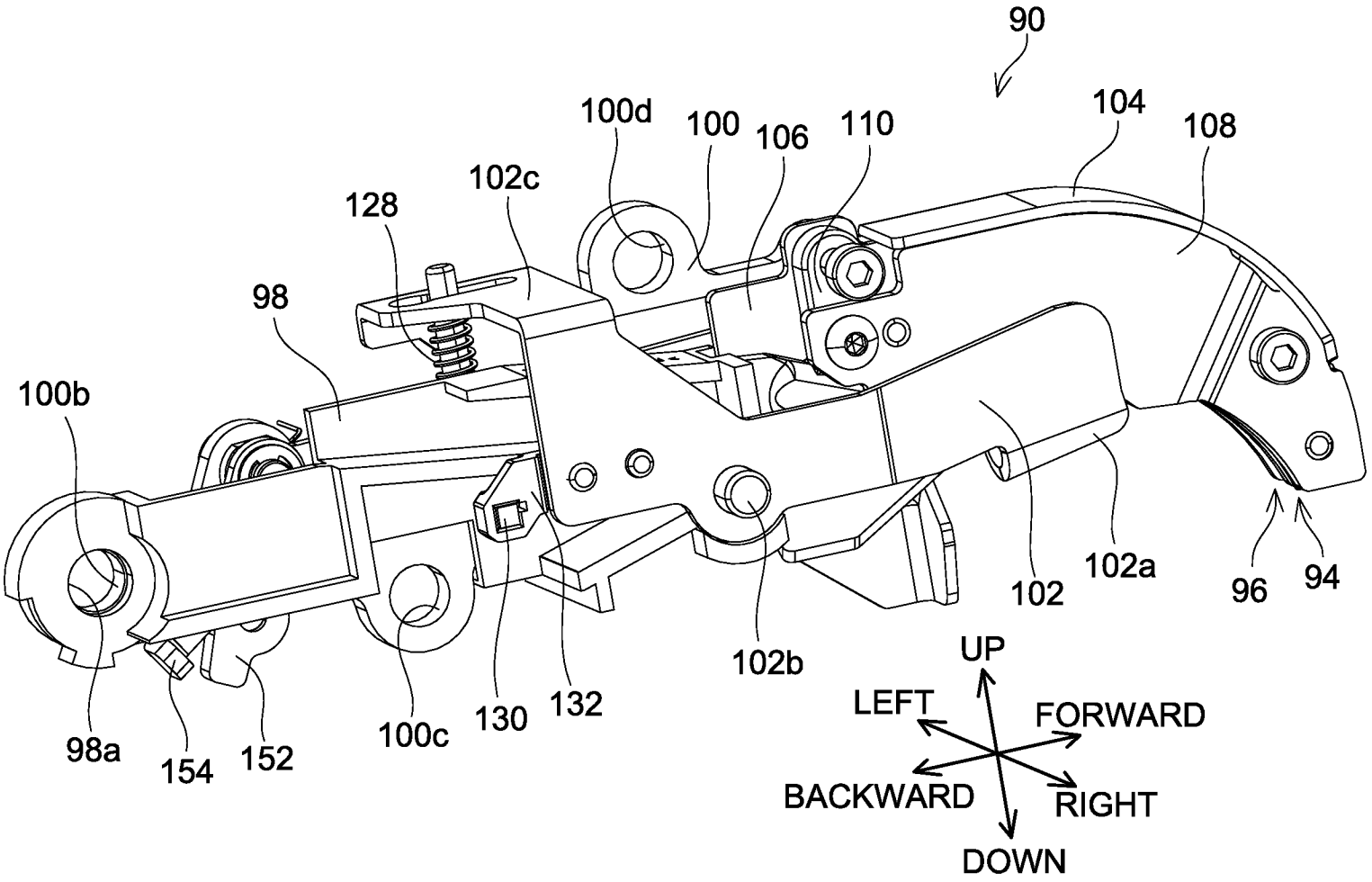
FIG. 19 is a perspective view seeing the upper curl guide 90 of the rebar tying machine 2 according to the embodiment from the upper right rear side.

As shown in FIGS. 18 and 19, the upper curl guide 90 is provided with a lead holder 98, a guide arm 100, a contact plate 102, a left guide plate 104, an inner guide plate 106, a right guide plate 108, a guide member 110 (see FIG. 20), and a top plate 112 (see FIG. 20).

The lead holder 98 retains the guide pipe 88 such that the front-side opening of the guide pipe 88 opens toward the first guiding passage 94 defined by the guide member 110, the right guide plate 108, the inner guide plate 106, and the top plate 112. As shown in FIG. 20, the guide member 110 is a metal member and is provided with a wire passage 110*a* through which the wire W passes therein. A first guide pin 114 is disposed at a lower front end of the wire passage 110*a*. The first guide pin 114 is a metal member having high wear resistance such as tungsten, and is press-fitted in the right guide plate 108. The wire W fed out from the guide pipe 88 is guided toward a cutter 116 by the wire passage 110*a* and the first guide pin 114.

The cutter 116 is provided with a fixing member 118 and a pivoting member 120. The fixing member 118 is a metal member having a cylindrical outer shape, and is provided with a wire passage 118*a* through which the wire W passes therein. The fixing member 118 is fitted with the inner guide plate 106 and is interposed by the right guide plate 108 and the inner guide plate 106. The pivoting member 120 is a metal member provided with a through hole 120*a* through which the fixing member 118 penetrates and a cutter piece 120*b* configured to cut the wire W. The pivoting member 120 is pivotably retained by the inner guide plate 106 and the right guide plate 108 via the fixing member 118. The cutter piece 120*b* is configured to shear the wire W when the pivoting member 120 pivots. The top plate 112 is a metal member and is fixed to the right guide plate 108. The wire W having passed the cutter 116 is further guided downward by a protrusion 112*a* of the top plate 112 and a second guide pin 122. The second guide pin 122 is a metal member having high wear resistance such as tungsten, and is press-fitted in the right guide plate 108. While the wire W passes through the first guiding passage 94, it is given a curl by an inner upper surface of the wire passage 110*a*, the first guide pin 114, and the second guide pin 122, and then is fed toward the lower curl guide 92.

The lower curl guide 92 is provided with a third guiding passage 124 and a guard plate 126. The third guiding passage 124 is provided with a left guide wall 124*a* and a right guide wall 124*b* configured to guide the wire W fed from a front end of the upper curl guide 90. The guard plate 126 has a shape extending upward on both sides of the third guiding passage 124, and prevents the plurality of rebars R from interfering with the twisting mechanism 46 and foreign matters from entering inside of the tying machine body 4. Further, the guard plate 126 prevents the wire W from meandering to left and right when the twisting mechanism 46 twists the wire W wound in a loop shape. The wire W guided by the lower curl guide 92 is fed toward the second guiding passage 96 of the upper curl guide 90.

Figure 21:
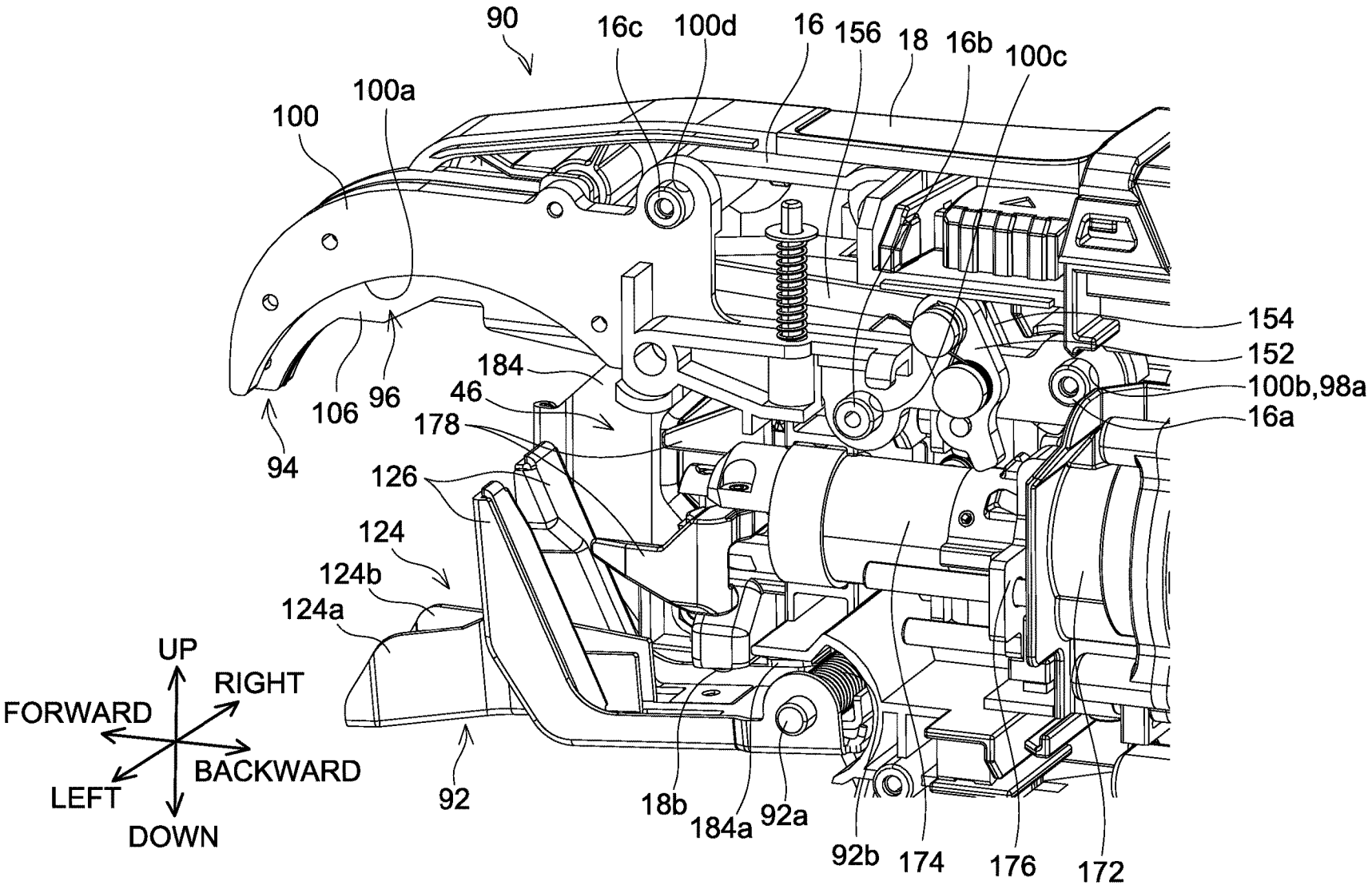
FIG. 21 is a perspective view seeing an internal structure of a second guiding passage 96 of the upper curl guide 90 and the internal structure of the tying machine body 4 of the rebar tying machine 2 according to the embodiment from the upper left rear side.

The wire W fed from a rear side of the lower curl guide 92 to a rear side of the upper curl guide 90 is fed into the second guiding passage 96 defined by the guide arm 100, the left guide plate 104, and the inner guide plate 106. As shown in FIG. 21, an arc-shaped upper guide wall 100*a* configured to guide the wire W is provided on a lower front surface of the guide arm 100. The wire W fed from the lower curl guide 92 to the upper curl guide 90 is guided by the second guiding passage 96 and is again fed from a front side of the upper curl guide 90 toward a front side of the lower curl guide 92.

As shown in FIGS. 18 and 19, the contact plate 102 is a substantially U-shaped member and is disposed to traverse the lead holder 98 and the guide arm 100. The contact plate 102 is provided with a contact portion 102*a*, a pivot shaft 102*b*, and a connecting portion 102*c*. The contact plate 102 is pivotably supported by the lead holder 98 via the pivot shaft 102*b*. The connecting portion 102*c* of the contact plate 102 is biased upward by a compression spring 128 retained by the lead holder 98. As shown in FIG. 19, the contact plate 102 is provided with a magnet arm 132 on which a magnet 130 is attached. As shown in FIG. 7, a magnetic sensor 134 is attached to the right housing 16 in the front part of the tying machine body 4. The magnetic sensor 134 is electrically connected to the control board 200. Under the normal state, the magnet 130 of the contact plate 102 is disposed at a position facing the magnetic sensor 134. When the rebar tying machine 2 is set with respect to the plurality of rebars R by the user and the plurality of rebars R is pressed against the contact portion 102*a*, the contact plate 102 pivots against biasing force of the compression spring 128 and the magnet 130 of the magnet arm 132 moves to a position offset from the magnetic sensor 134. The control board 200 is configured to detect whether or not the plurality of rebars R is pressed against the contact portion 102*a* from a detection signal of the magnetic sensor 134.

As shown in FIG. 19, the lead holder 98 is provided with one attachment hole 98*a*. As shown in FIG. 18, the guide arm 100 is provided with three attachment holes 100*b*, 100*c*, 100*d*. The attachment hole 98*a* of the lead holder 98 and one attachment hole 100*b* of the guide arm 100 are disposed to overlap each other. As shown in FIG. 8, screw bosses 16*a*, 16*b*, 16*c* used for attaching the left housing 14 to the right housing 16 are provided in the right housing 16 in the front part of the tying machine body 4. The upper curl guide 90 is attached to the right housing 16 by fitting the attachment hole 98*a* of the lead holder 98 and the attachment hole 100*b* of the guide arm 100 to the screw boss 16*a*, fitting the attachment hole 100*c* of the guide arm 100 to the screw boss 16*b*, and fitting the attachment hole 100*d* of the guide arm 100 to the screw boss 16*c*. By attaching the upper curl guide 90 to the right housing 16 by using the screw bosses 16*a*, 16*b*, 16*c* used for attaching the left housing 14 to the right housing 16, the upper curl guide 90 can be attached to the right housing 16 without increasing a number of components. Further, the upper curl guide 90 can accurately be positioned with respect to the right housing 16. Further, since portions where the screw bosses 16*a*, 16*b*, 16*c* are provided have relatively high strength within the right housing 16, high durability can be ensured even when load generated by collision with the plurality of rebars R is transmitted from the upper curl guide 90 to the right housing 16. A number of portions where the upper curl guide 90 is attached to the right housing 16 may be any number so long as it is two or more. Among them, a number of the portion(s) where the upper curl guide 90 is attached by using the screw boss(es) for attaching the left housing 14 to the right housing 16 may be one or two, or may be four or more. By providing two or more portions where the upper curl guide 90 is attached by using the screw bosses, the upper curl guide 90 can accurately be positioned with respect to the right housing 16. Further, higher durability can be ensured with a larger number of the portions where the upper curl guide 90 is attached by using the screw bosses.

As shown in FIG. 8, the lower curl guide 92 is pivotably supported by the left housing 14 and the right housing 16 via a pivot shaft 92*a*. The lower curl guide 92 is pivotable between a closed state shown in FIG. 22 and an opened state shown in FIG. 23. As shown in FIG. 8, the lower curl guide 92 is biased in its closing direction by a torsion spring 92*b*. When the user uses the rebar tying machine 2, the lower curl guide 92 is in the closed state. In a case where the wire W is tangled in the twisting mechanism 46 while the user is using the rebar tying machine 2, the user can open the lower curl guide 92 against biasing force of the torsion spring 92*b* to remove the tangled wire W in the twisting mechanism 46.

Figure 22:
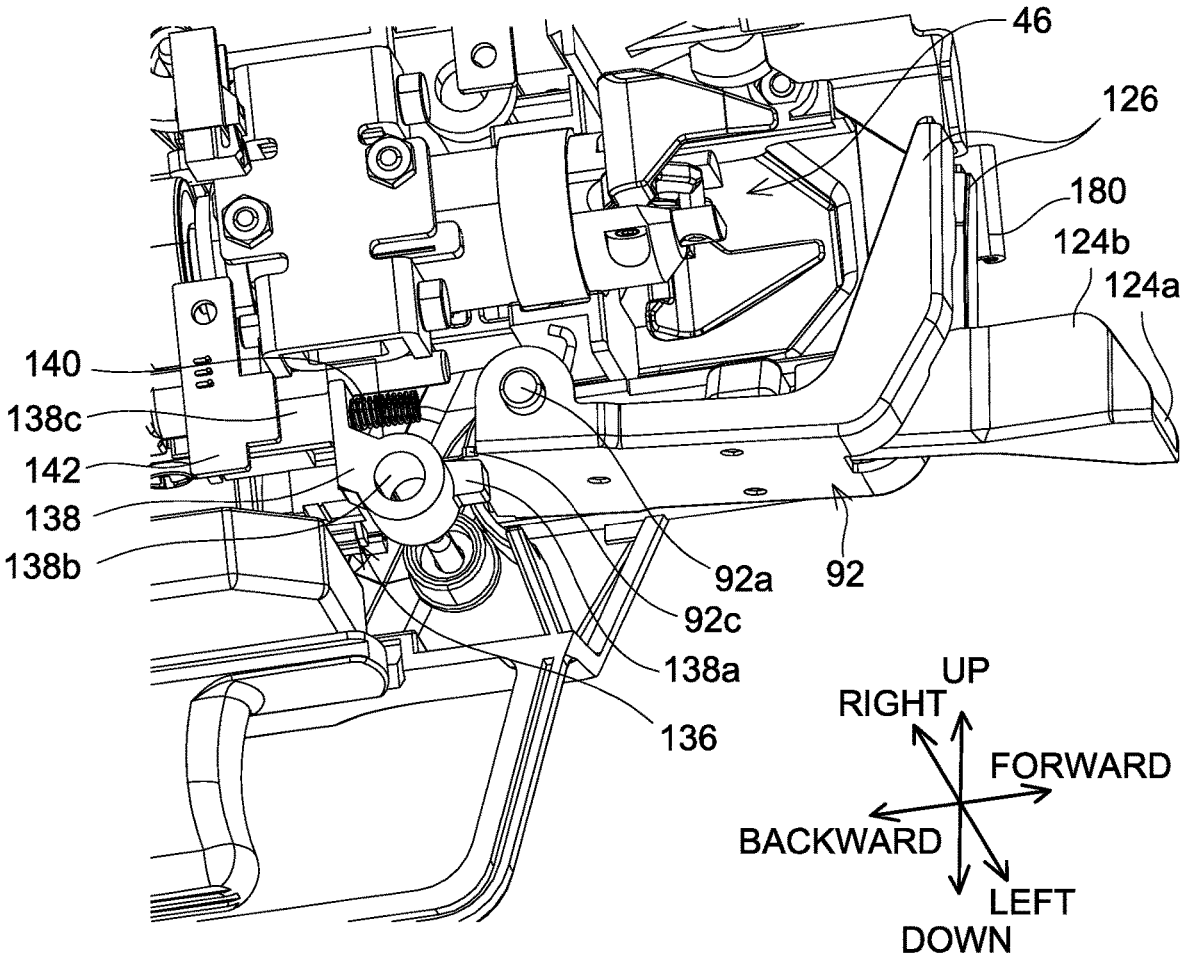
FIG. 22 is a perspective view seeing the internal structure of the tying machine body 4 from a lower right front side when a lower curl guide 92 is closed in the rebar tying machine 2 according to the embodiment.
Figure 23:
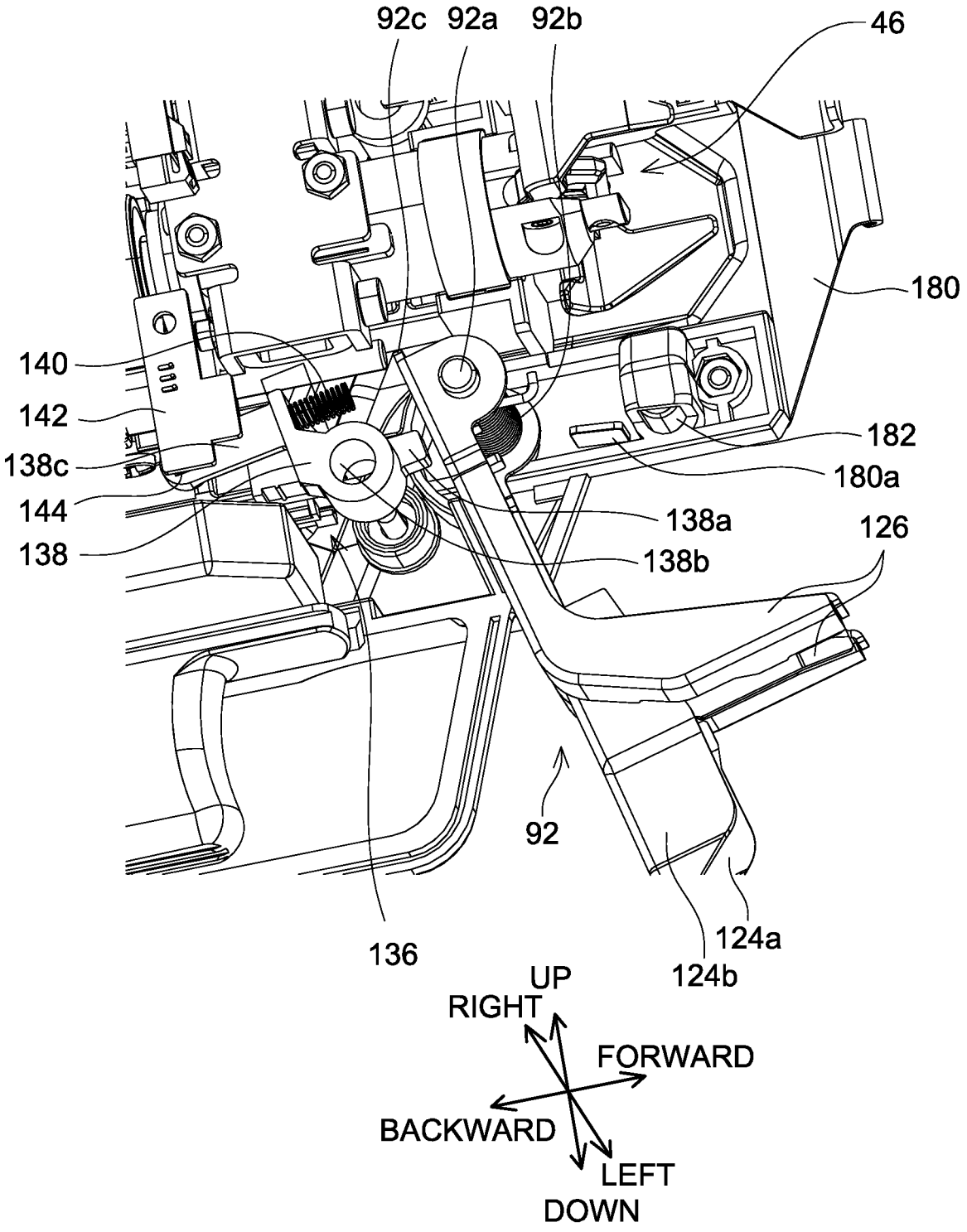
FIG. 23 is a perspective view seeing the internal structure of the tying machine body 4 from the lower right front side when the lower curl guide 92 is open in the rebar tying machine 2 according to the embodiment.

As shown in FIGS. 22 and 23, an open/close detection mechanism 136 configured to detect the opened and closed states of the lower curl guide 92 is provided at a lower front part of the tying machine body 4. The open/close detection mechanism 136 is attached to the right housing 16. The open/close detection mechanism 136 is provided with an open/close detection member 138, a compression spring 140, and a magnetic sensor 142. The open/close detection member 138 is provided with a contact arm 138*a* and a magnet arm 138*c*. The open/close detection member 138 is pivotably supported by the right housing 16 via a pivot shaft 138*b*. Further, the open/close detection member 138 is biased in a pivoting direction along which the contact arm 138*a* moves upward by the compression spring 140 retained by the right housing 16. A magnet 144 (see FIG. 23) is attached to the magnet arm 138*c* of the open/close detection member 138. The magnetic sensor 142 is fixed to the right housing 16. The magnetic sensor 142 is electrically connected to the control board 200. A contact portion 92*c* protruding rearward is provided at a lower rear part of the lower curl guide 92. As shown in FIG. 22, in the state where the lower curl guide 92 is closed by the biasing force of the torsion spring 92*b*, the contact portion 92*c* of the lower curl guide 92 is pressing down the contact arm 138*a* of the open/close detection member 138, and the magnet 144 of the magnet arm 138*c* is disposed at a position facing the magnetic sensor 142. As shown in FIG. 23, when the user opens the lower curl guide 92 against the biasing force of the torsion spring 92*b*, the contact portion 92*c* of the lower curl guide 92 separates away from the contact arm 138*a* of the open/close detection member 138. Due to this, the open/close detection member 138 pivots by biasing force of the compression spring 140, and the magnet 144 of the magnet arm 138*c* is moved to a position offset from the magnetic sensor 142. The control board 200 is configured to detect the opened and closed states of the lower curl guide 92 from a detection signal of the magnetic sensor 142. As shown in FIG. 23, a rigid stopper 180*a* and an elastic stopper 182 extending from a metal side plate 180 attached to the left housing 14 are provided on the left housing 14 near the lower curl guide 92. The elastic stopper 182 may be constituted of, for example, an elastic material such as a urethane pin, a rubber pin, or elastomer. Further, as shown in FIGS. 20 and 21, a rigid stopper 184*a* and an elastic stopper 186 extending from a metal side plate 184 attached to the right housing 16 are provided on the right housing 16 near the lower curl guide 92. The elastic stopper 186 may be constituted of, for example, an elastic material such as an urethane pin, a rubber pin, or elastomer. When the lower curl guide 92 is closed as shown in FIG. 22 from its opened state as shown in FIG. 23, the lower curl guide 92 firstly contacts with the elastic stoppers 182, 186, and thereafter contacts with the rigid stoppers 180*a*, 184*a*. With such a configuration, even when the lower curl guide 92 is closed with strong force, generation of a large colliding sound can be suppressed.

As shown in FIG. 1, the upper curl guide 90 feeds out the wire W downward from an upper front side of the rebars R, and the lower curl guide 92 feeds out the wire W, which has been fed from the upper curl guide 90, upward from a lower rear side of the rebars R. Due to this, the wire W fed from the feed mechanism 38 is wound in a loop shape around the rebars R. The feed mechanism 38 stops the feed motor 72 and stops feeding the wire W when the wire W has been fed out by a feed amount thereof set by the user.

Figure 24:
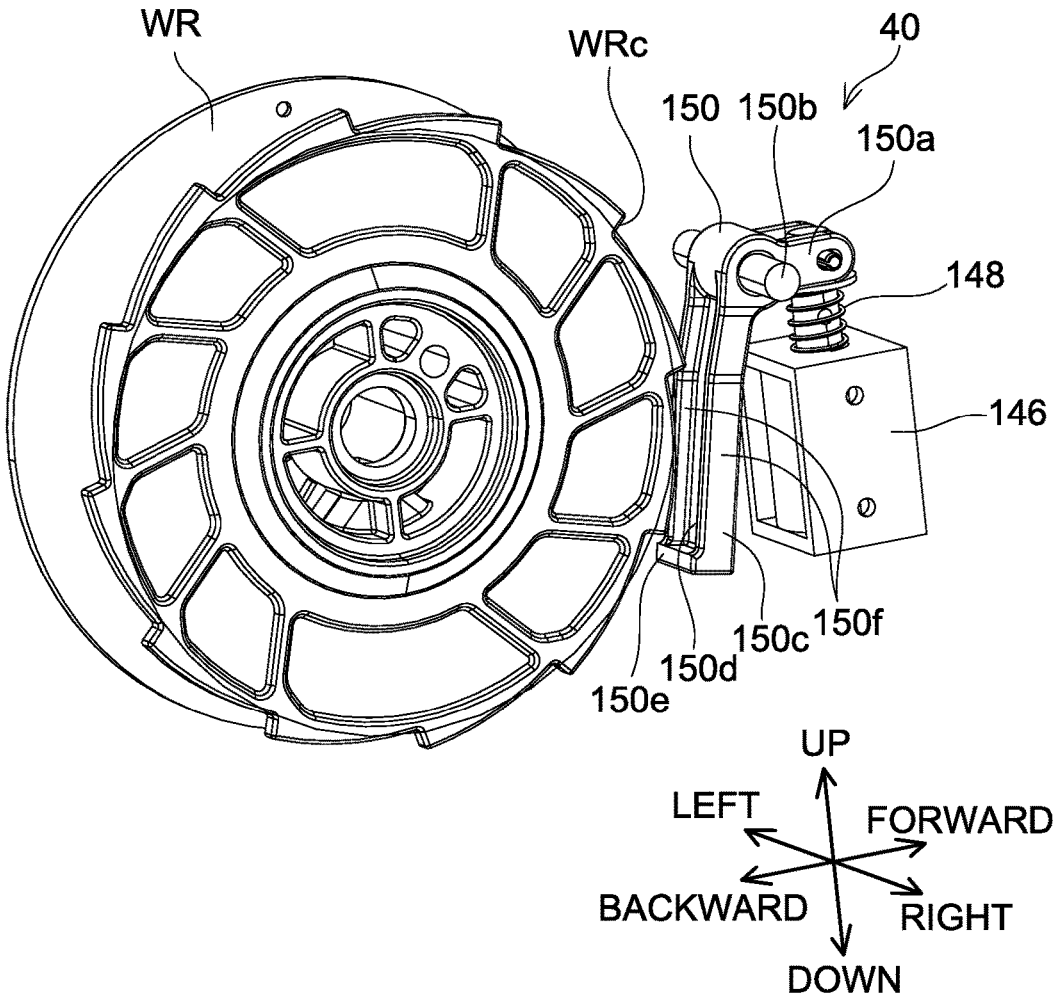
FIG. 24 is a perspective view seeing the wire reel WR and a brake mechanism 40 from the upper right rear side when a solenoid 146 is not electrically conducted in the rebar tying machine 2 according to the embodiment.
Figure 25:
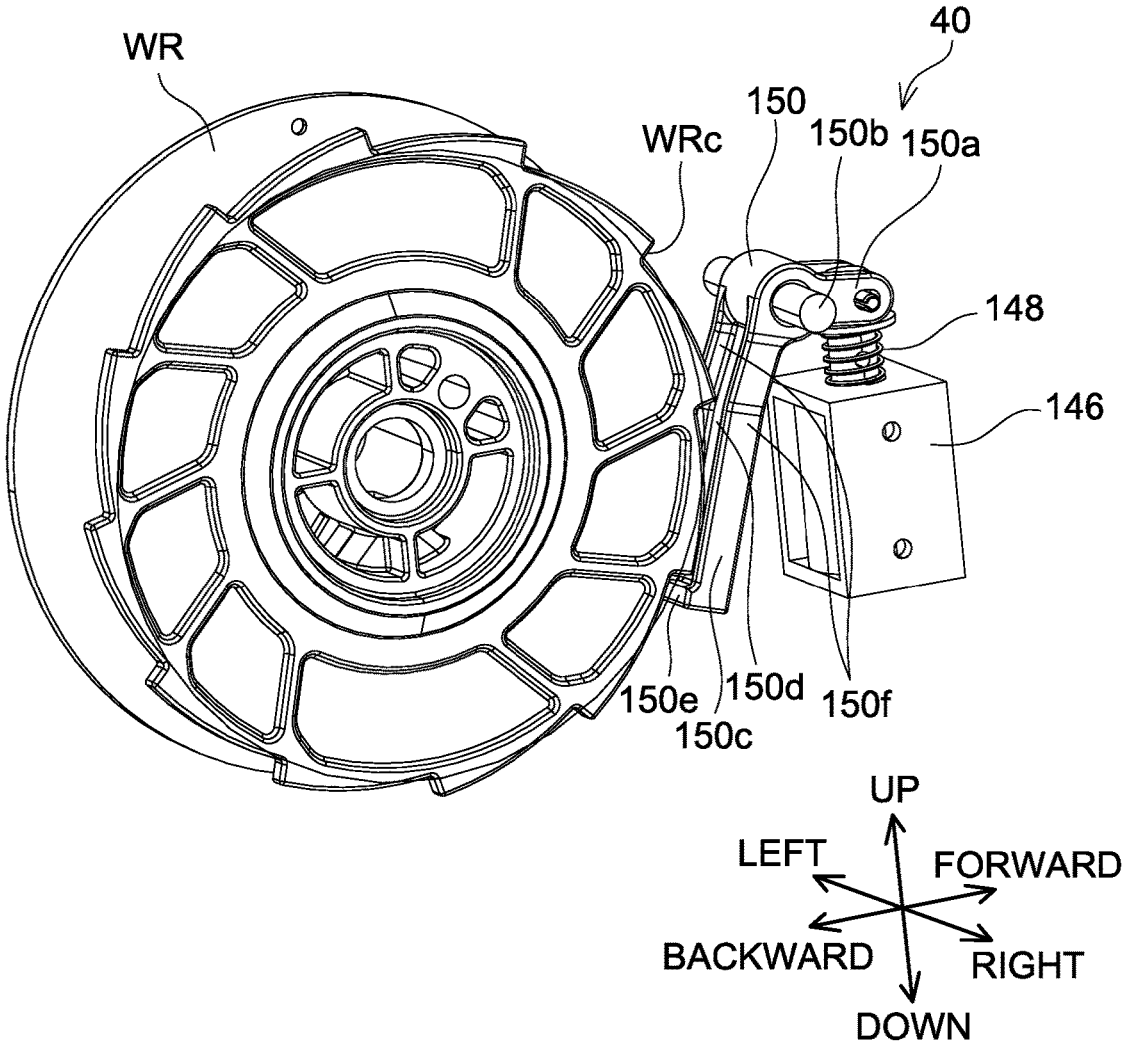
FIG. 25 is a perspective view seeing the wire reel WR and the brake mechanism 40 from the upper right rear side when the solenoid 146 is electrically conducted in the rebar tying machine 2 according to the embodiment.

The brake mechanism 40 shown in FIG. 7 stops rotation of the wire reel WR in conjunction with the feed mechanism 38 stopping feeding out the wire W. As shown in FIGS. 24 and 25, the brake mechanism 40 is provided with a solenoid 146, a compression spring 148, and a brake member 150. The solenoid 146 is electrically connected to the control board 200. The control board 200 is configured to control an operation of the solenoid 146. The brake member 150 is a single member provided with a driving arm 150*a* and a braking arm 150*c*. The brake member 150 is pivotably attached to the right housing 16 via a pivot shaft 150*b*. An output shaft of the solenoid 146 which moves in an up-and-down direction is connected to the driving arm 150*a* of the brake member 150. Further, the brake member 150 is biased in a pivoting direction along which the braking arm 150*c* separates away from the wire reel WR by the compression spring 148. The braking arm 150*c* of the brake member 150 is provided with a plate portion 150*d* having a wide plate shape, a distal end rib 150*e* protruding to a wire reel WR side at a distal end of the plate portion 150*d*, and side end ribs 150*f* protruding to the wire reel WR side on both sides of the plate portion 150*d*. The wire reel WR is provided with engaging portions WRc at predetermined angle intervals in its circumferential direction. The distal end rib 150*e* of the braking arm 150*c* engages with one of the engaging portions WRc. As shown in FIG. 24, in a state where the solenoid 146 is not electrically conductive, the braking arm 150*c* is separated away from the engaging portions WRc of the wire reel WR by biasing force of the compression spring 148. As shown in FIG. 25, in a state where the solenoid 146 is electrically conductive, the solenoid 146 drives the driving arm 150*a* and torque about the pivot shaft 150*b* is applied on the brake member 150, by which the brake member 150 pivots about the pivot shaft 150*b* and the distal end rib 150*e* of the braking arm 150*c* engages with one of the engaging portions WRc of the wire wheel WR. When the feed mechanism 38 feeds out the wire W, the control board 200 does not electrically conduct the solenoid 146 to separate the braking arm 150*c* away from the engaging portions WRc of the wire reel WR. Due to this, the wire reel WR can rotate freely, and the feed mechanism 38 can draw out the wire W from the wire reel WR. Further, when the feed mechanism 38 stops feeding out the wire W, the control board 200 electrically conducts the solenoid 146 to make the braking arm 150*c* engage with one of the engaging portions WRc of the wire reel WR. Due to this, the rotation of the wire wheel WR is prohibited. As such, the wire W can be prevented from becoming loose between the wire wheel WR and the feed mechanism 38 due to the wire wheel WR continuing to rotate by inertia even after the feed mechanism 38 has stopped feeding out the wire W.

As shown in FIG. 7, the brake mechanism 40 is disposed outside the right housing 16, and is housed in a space defined by the right housing 16 and the side-surface cover housing 18. As shown in FIG. 9, a brake opening 16*d* having a size that is substantially equal to a size of the braking arm 150*c* of the brake member 150 is provided in the right housing 16 of the reel housing compartment 20. With such a configuration, although the brake opening 16*d* is present between the wire reel WR and the solenoid 146, these members are partitioned from each other by the plate portion 150*d* of the braking arm 150*c*. As such, foreign matters can be prevented from moving to a solenoid 146 side from inside of the reel housing compartment 20 through the brake opening 16*d*. The solenoid 146 can be prevented from being affected by the foreign matters. As shown in FIG. 9, the braking arm 150*c* of the brake member 150 has a shape bent in the left-and-right direction such that its lower part is located at a leftwardly offset position as compared to its upper part. With such a configuration, the solenoid 146 can be disposed at a rightwardly offset position relative to the engaging portions WRc of the wire reel WR. In the rebar tying machine 2 of the present embodiment, a twist motor 170 of the twisting mechanism 46 to be described later is disposed on a frontside of the wire reel WR. According to the above configuration, the twist motor 170 of the twisting mechanism 46 and the solenoid 146 can be disposed side by side in the left-and-right direction, by which the tying machine body 4 can be made compact.

As shown in FIGS. 24 and 25, the solenoid 146 is disposed so that its longitudinal direction becomes substantially parallel to a tangential direction of rotary motion of a portion of the wire reel WR that is closest to the solenoid 146. Further, the solenoid 146 is disposed so that its longitudinal direction becomes substantially parallel to a shaft of the feed motor 72. With such a configuration, as shown in FIG. 7, the solenoid 146 can be disposed between the wire wheel WR and the feed motor 72 even if the wire wheel WR and the feed motor 72 are disposed close to each other in the front-and-rear direction of the tying machine body 4, by which the tying machine body 4 can be made compact. Further, by the solenoid 146 being interposed between the wire wheel WR and the feed motor 72, some degree of space can be ensured between the wire reel WR and the guide member 68 provided above the feed motor 72. When this space between the guide member 68 and the wire reel WR is too small, work for the user to pass the wire W drawn out from the wire wheel WR through the insertion hole 68*a* of the guide member 68 becomes difficult. According to the configuration of the present embodiment, some degree of space can be ensured between the wire reel WR and the guide member 68 provided above the feed motor 72 even if wire reel WR and the feed motor 72 are disposed close to each other, by which workability for the user can be improved.

In the rebar tying machine 2, a partition wall for partitioning the solenoid 146 and the wire reel WR may not be provided on the right housing 16 and the side-surface cover housing 18, and the solenoid 146 and the wire reel WR may be partitioned only by the brake member 150. In this case, the solenoid 146 and the wire reel WR can be disposed even closer to each other, and the tying machine body 4 can further be made compact.

In the rebar tying machine 2 of the present embodiment, the braking arm 150*c* of the brake member 150 is provided with the plate portion 150*d* having the wide plate shape, the distal end rib 150*e* protruding to the wire reel WR side at the distal end of the plate portion 150*d*, and the side end ribs 150*f* protruding to the wire reel WR side on both sides of the plate portion 150*d*. With such a configuration, strength of the braking arm 150*c* is increased and durability of the brake member 150 can be improved. The side end ribs 150*f* may protrude to a solenoid 146 side.

As shown in FIG. 8, the cutting mechanism 44 is disposed in the front part of the tying machine body 4, and cuts the wire W with the wire W wound around the rebars R. As shown in FIGS. 18, 19, and 20, the cutting mechanism 44 is configured as a unit with the upper curl guide 90 of the guide mechanism 42. The cutting mechanism 44 is provided with a push plate 152, a pull plate 154, a first link arm 156, a second link arm 158, and the cutter 116. The push plate 152, the pull plate 154, and the first link arm 156 are pivotably connected to each other via a pivot shaft 160. Further, the push plate 152 and the pull plate 154 are pivotably supported by the guide arm 100 via a pivot shaft 162. The first link arm 156 is biased forward by a torsion spring 164. As shown in FIG. 20, the first link arm 156 and the second link arm 158 are pivotably connected to each other via a pivot shaft 166. The second link arm 158 is pivotably connected to the pivoting member 120 of the cutter 116 via a pivot shaft 168.

When a lower part of the push plate 152 is pushed forward by an operation of the twisting mechanism 46 to be described later, the first link arm 156 and the second link arm 158 move rearward, by which the pivoting member 120 of the cuter 116 pivots about the fixing member 118. Due to this, the wire W is sheared by the cutter piece 120*b* of the pivoting member 120 at a front end of the wire passage 118*a* of the fixing member 118. When a lower part of the pull plate 154 is pushed rearward by the operation of the twisting mechanism 46 from this state, the first link arm 156 and the second link arm 158 move forward, by which the pivoting member 120 of the cutter 116 pivots about the fixing member 118 and the cutter 116 returns to its initial state.

Figure 26:
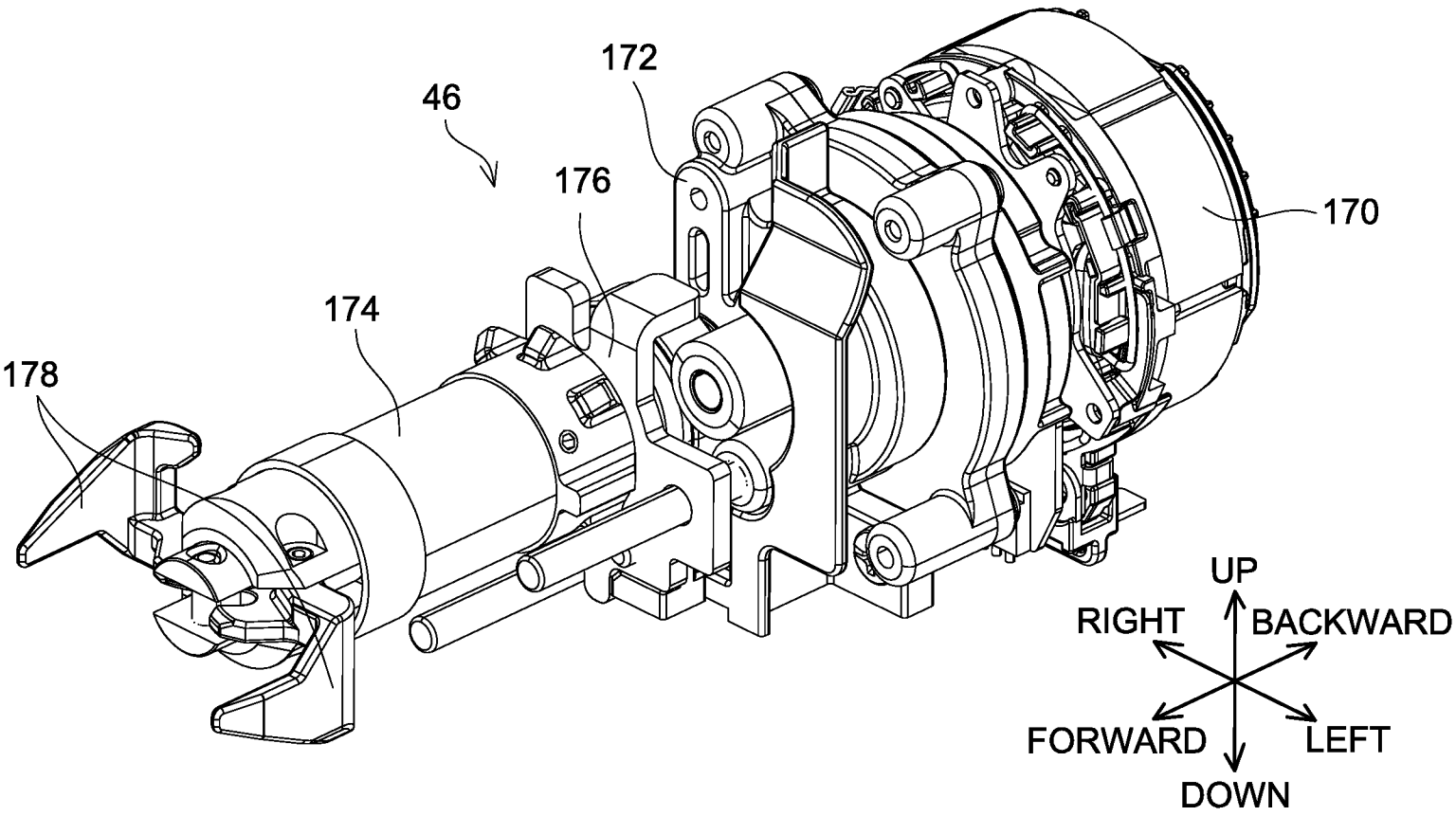
FIG. 26 is a perspective view seeing a twisting mechanism 46 of the rebar tying machine 2 according to the embodiment from the upper left front side.

The twisting mechanism 46 shown in FIG. 8 is disposed in an area from the front part of the tying machine body 4 to an intermediate part thereof in the front-and-rear direction. The twisting mechanism 46 is configured to twist the wire W wound around the rebars R to tie the rebars R with the wire W. As shown in FIG. 26, the twisting mechanism 46 is provided with the twist motor 170, a reduction mechanism 172, a sleeve 174, a screw shaft that is not shown but disposed inside the sleeve 174, a pusher 176, and a pair of hooks 178.

The twist motor 170 is a direct current brushless motor. The twist motor 170 is electrically connected to the control board 200. The control board 200 is configured to control an operation of the twist motor 170. Rotation of the twist motor 170 is transmitted to the screw shaft through the reduction mechanism 172. The twist motor 170 is configured to rotate in a forward direction and in a reverse direction, according to which the screw shaft is configured to rotate in the forward direction and in the reverse direction. The sleeve 174 is disposed to cover a periphery of the screw shaft. In a state where rotation of the sleeve 174 is prohibited, the sleeve 174 moves forward when the screw shaft rotates in the forward direction, and the sleeve 174 moves rearward when the screw shaft rotates in the reverse direction. Further, in a state where the rotation of the sleeve 174 is allowed, the sleeve 174 rotates together with the screw shaft when the screw shaft rotates. The pusher 176 moves forward when the sleeve 174 moves forward, and moves rearward when the sleeve 174 moves rearward. When the sleeve 174 moves forward to a predetermined position from its initial position, the pusher 176 pushes the lower part of the push plate 152 of the cutting mechanism 44 forward, by which the pivoting member 120 of the cutter 116 pivots about the fixing member 118. To the contrary, when the sleeve 174 moves rearward to a predetermined position from its forward position, the pusher 176 pushes the lower part of the pull plate 154 of the cutting mechanism 44 rearward, by which the pivoting member 120 of the cutter 116 pivots about the fixing member 118. The pair of hooks 178 are provided at a front end of the sleeve 174, and are configured to open and close according to a position of the sleeve 174 in the front-and-rear direction. The pair of hooks 178 close to grip the wire W when the sleeve 174 moves forward. To the contrary, the pair of hooks 178 open to release the wire W when the sleeve 174 moves rearward.

The control board 200 causes the twist motor 170 to rotate in the state where the wire W is wound around the rebars R. At this occasion, the rotation of the sleeve 174 is prohibited, so the sleeve 174 moves forward by the rotation of the screw shaft, the pusher 176 and the pair of hooks 178 move forward therewith, the wire W is cut by the cutting mechanism 44, and the pair of hooks 178 close to grip the wire W. Then, when the rotation of the sleeve 174 is allowed, the sleeve 174 rotates by the rotation of the screw shaft and the pair of hooks 178 also rotate. Due to this, the wire W is twisted, and the rebars R are thereby tied. The twisting strength of the wire W may be preset by the user. When the wire W is twisted to the twisting strength as set, the control board 200 causes the twist motor 170 to rotate in the reverse direction. In doing so, the rotation of the sleeve 174 is prohibited, so the sleeve 174 moves rearward by the rotation of the screw shaft, the pair of hooks 178 also move rearward while opening, and the wire W is thereby released. Further, the pusher 176 also moves rearward as the sleeve 174 moves rearward, and the cutting mechanism 44 returns to its initial state. After this, the pusher 176 and the pair of hooks 178 move rearward to the initial positions, the rotation of the sleeve 174 is allowed, and the pair of hooks 178 return to their initial angles.

As shown in FIG. 1, when the user sets the rebar tying machine 2 so that the plurality of rebars R is positioned between the upper curl guide 90 and the lower curl guide 92 and performs the pulling manipulation on the trigger 28, the rebar tying machine 2 performs a series of operations to wind the wire W around the rebars R by the feed mechanism 38, the brake mechanism 40, and the guide mechanism 42, and to cut the wire W and twist the wire W wound on the rebars R by the cutting mechanism 44 and the twisting mechanism 46.

Figure 27:
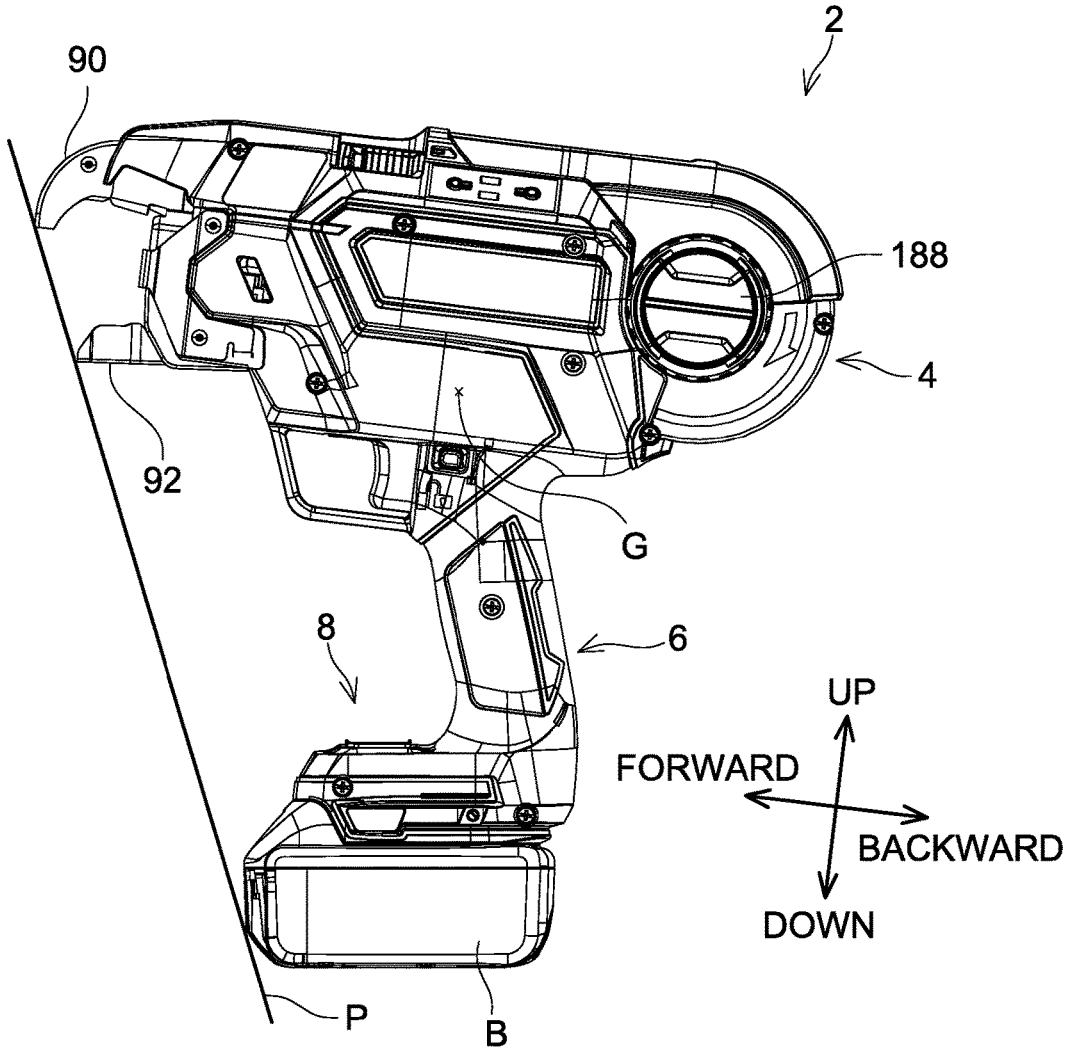
FIG. 27 is a left-side view of the rebar tying machine 2 according to the embodiment.

As shown in FIG. 27, the rebar tying machine 2 of the present embodiment has the grip 6 tilted from an upper front side toward a lower rear side with respect to the tying machine body 4. A tilt angle of the grip 6 with respect to the tying machine body 4 is an angle between 65 to 80 degrees, and may be an angle between 70 to 75 degrees. With such a configuration, burden on a wrist of the user upon using the rebar tying machine 2 can be reduced. Further, in the rebar tying machine 2 of the present embodiment, a gravity center position G in a state where the battery B has been attached is located immediately above a proximal base of the grip 6 connected to the tying machine body 4. With such a configuration, the burden on the wrist of the user upon using the rebar tying machine 2 can be reduced. Moreover, in the rebar tying machine 2 of the present embodiment, a rear surface of the grip 6 and a rear surface of the battery receiver 8 are configured in shapes which are smoothly continued without any steps. With such a configuration, the smoothly-shaped portion comes into contact with a palm of the user when the rebar tying machine 2 is used in a downward orientation, and burden on the palm of the user can thereby be reduced.

In the rebar tying machine 2 of the present embodiment, when seen from below with a lower surface of the battery B as a reference, the gravity center position G in the state where the battery B has been attached is disposed within the lower surface of the battery B. With such a configuration, the rebar tying machine 2 can stably stand on its own even when placed with the lower surface of the battery B as a mount surface in the state where the battery B has been attached. Further, in the rebar tying machine 2 of the present embodiment, in regard to a sliding direction of the battery B, a rear-side end of the battery B is located on the front side than a rear-side end of the grip 6 when the battery B is attached. With such a configuration, the battery B can be suppressed from interfering with a forearm of the user when the user works by using the rebar tying machine 2.

In the rebar tying machine 2 of the present embodiment, a distal end of the lower curl guide 92 has a shape which does not exceed a plane P contacting a distal end of the upper curl guide 90 and a distal end of the battery B. With such a configuration, when the rebar tying machine 2 falls to the ground, the upper curl guide 90 or the battery B collides with the ground before the lower curl guide 92 collides with the ground. Since the lower curl guide 92 includes the mechanism which opens and closes relative to the tying machine body 4, its durability against impact is low as compared to the upper curl guide 90 and the battery B. With the configuration as above, damage to the lower curl guide 92 by impact can be suppressed. Even in a case where the distal end of the lower curl guide 92 has a shape which slightly protrudes from the plane P contacting the distal end of the upper curl guide 90 and the distal end of the battery B, the same effect as above can be achieved so long as a protruding amount thereof is small enough to be absorbed by elastic deformations of the lower curl guide 92 and the respective components constituting the open/close mechanism thereof and backlash between the respective components.

As shown in FIGS. 1 and 2, in the rebar tying machine 2 of the present embodiment, an elastic cover 188 is provided on an outer surface of the cover retainer 54*a* of the housing mechanism 36 which retains the attaching portion 22*a* of the reel cover 22, and an elastic cover 190 is provided on an outer surface of the cover retainer 18*a* of the side-surface cover housing 18 which retains the attaching portion 22*b* of the reel cover 22. Both elastic covers 188, 190 are constituted of an elastic material such as elastomer. Due to this, even when the rebar tying machine 2 is laid down with its side downward, the elastic covers 188, 190 serve as bumpers to protect the components inside the rebar tying machine 2 from impact.

The above embodiment describes the configuration in which the housing mechanism 36 includes the plurality of magnets 60*c* provided at the turntable 60 and the magnetic sensor 66 to detect the rotation of the wire reel WR. Unlike this configuration, a configuration may be employed in which a plurality of magnets is directly attached to the wire reel WR with a predetermined angular interval provided between each pair of the magnets but the plurality of magnets 60*c* is not attached to the turntable 60. In this case as well, the rotation of the wire reel WR can be detected from changes in magnetics of the magnets of the wire reel WR detected by the magnetic sensor 66.

Figure 28:
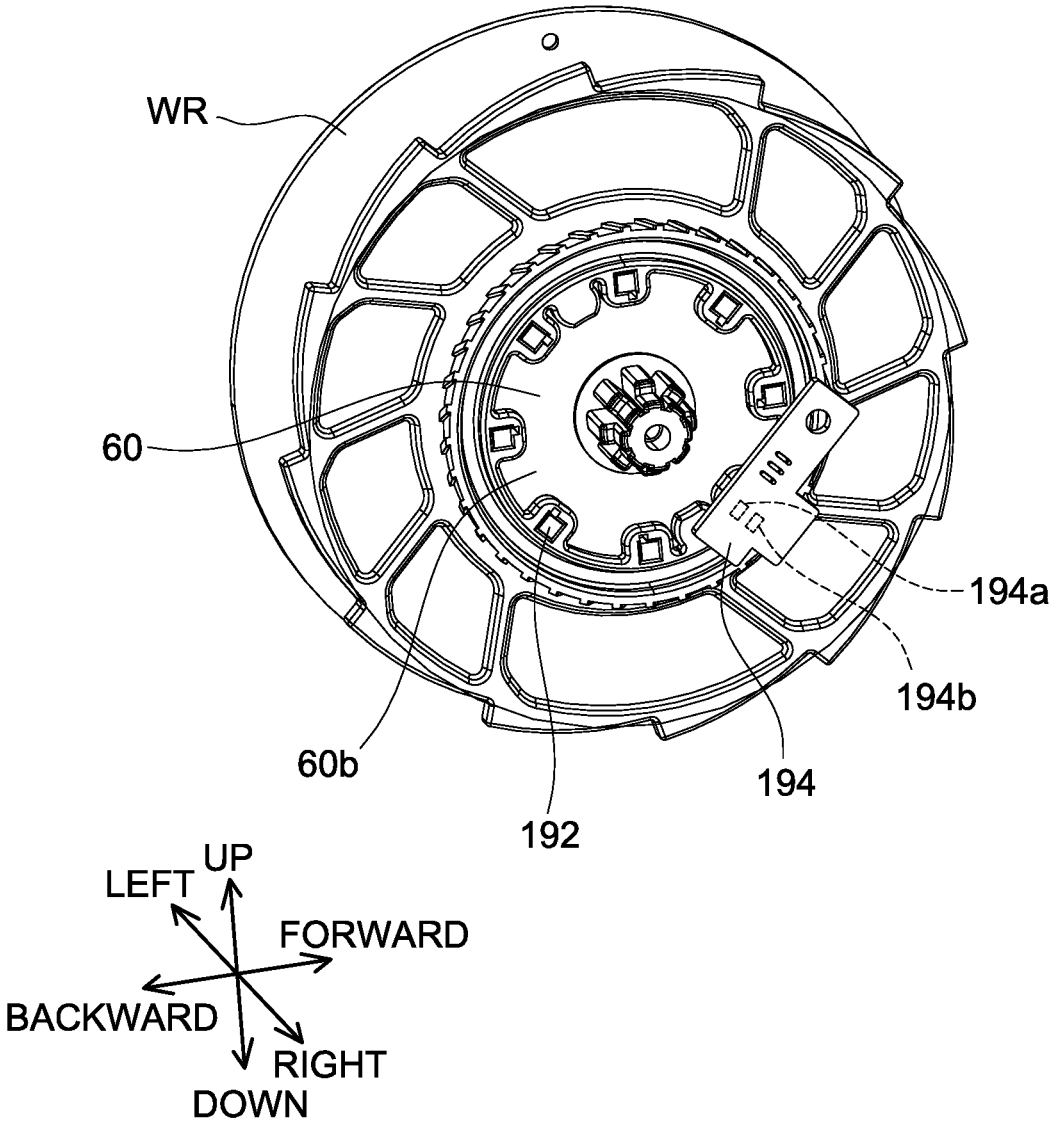
FIG. 28 is a perspective view seeing a wire reel WR, a turntable 60, and an optical sensor 194 of a rebar tying machine 2 according to a variant from the upper right rear side.
Figure 29:
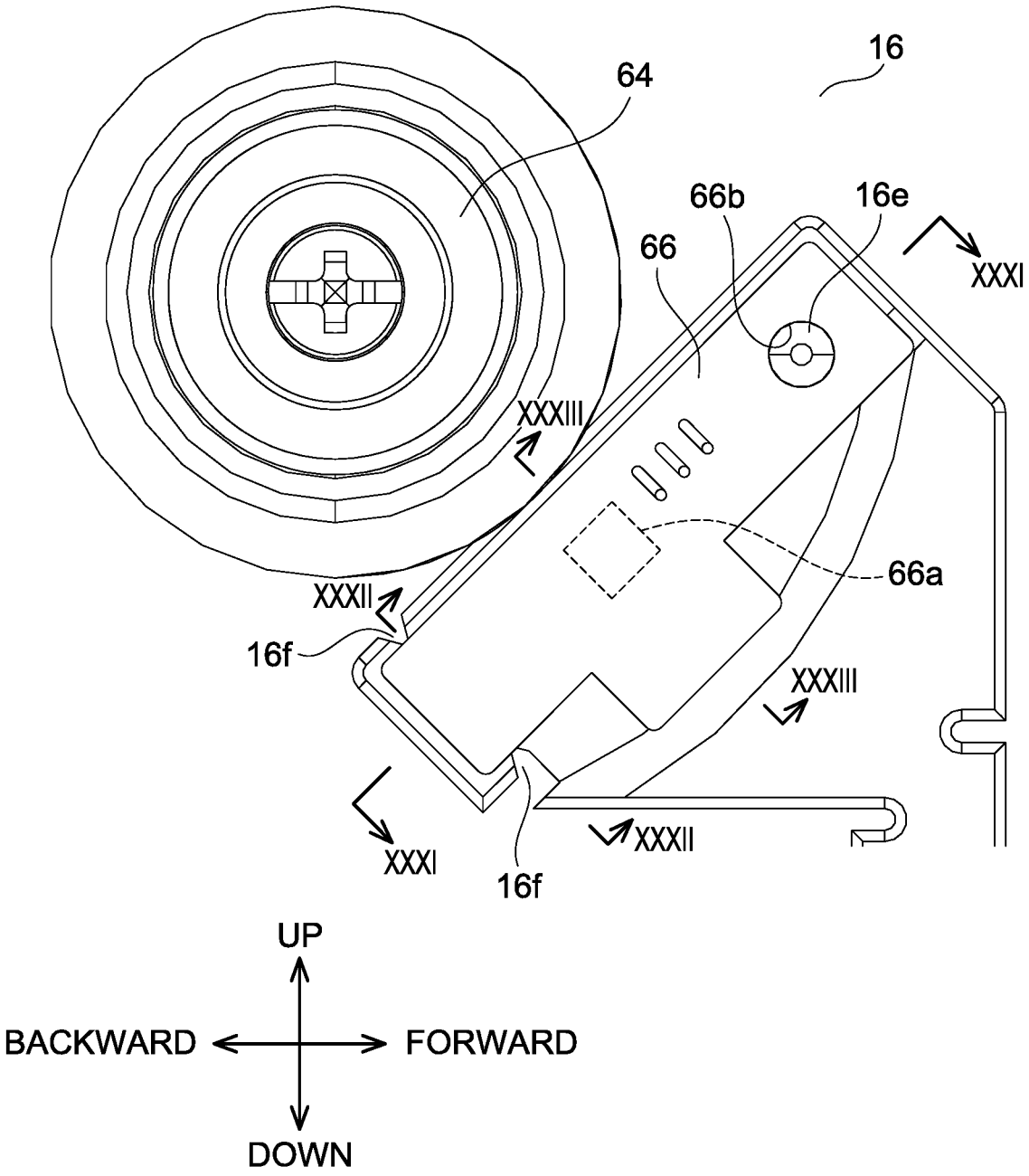
FIG. 29 is a right-side view of a state where the magnetic sensor 66 is attached to a right housing 16 of the rebar tying machine 2 according to the embodiment.
Figure 30:
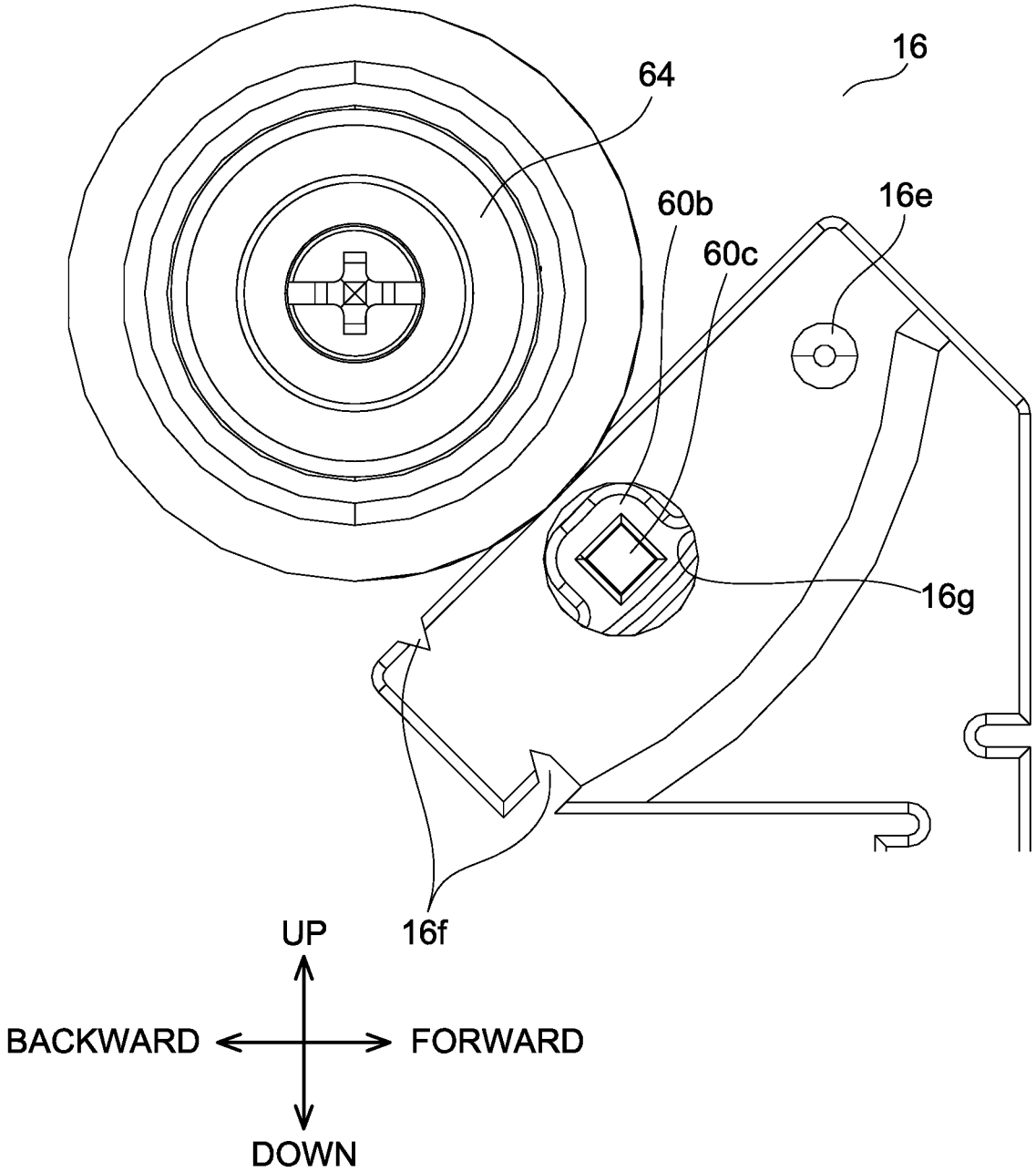
FIG. 30 is a right-side view of a state before the magnetic sensor 66 is attached to the right housing 16 of the rebar tying machine 2 according to the embodiment.
Figure 31:
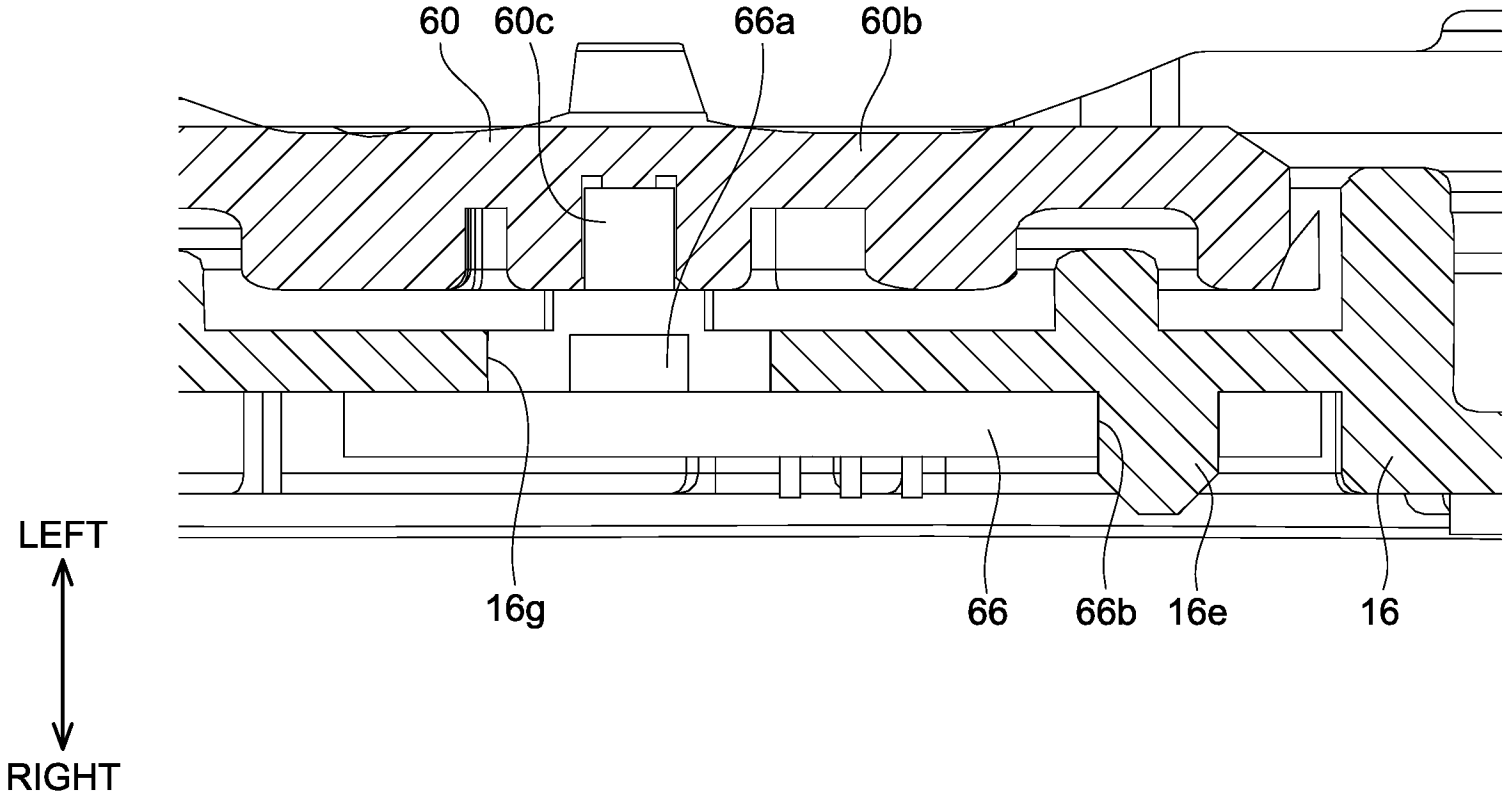
FIG. 31 is a cross-sectional view of the right housing 16, the turntable 60, and the magnetic sensor 66 of the rebar tying machine 2 according to the embodiment along a line XXXI-XXXI in FIG. 29.
Figure 32:
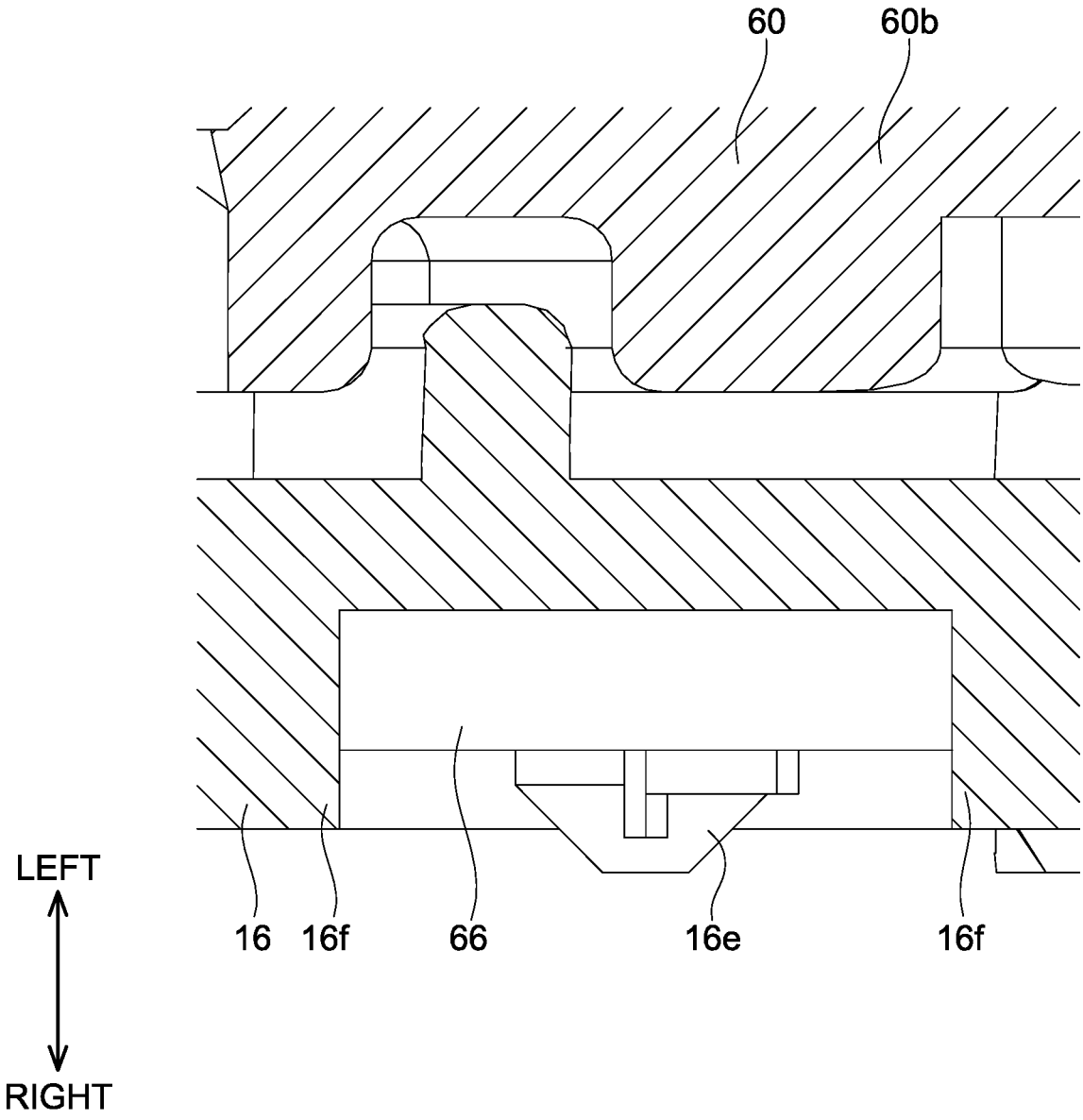
FIG. 32 is a cross-sectional view of the right housing 16, the turntable 60, and the magnetic sensor 66 of the rebar tying machine 2 according to the embodiment along a line XXXII-XXXII in FIG. 29.

The above embodiment describes the configuration in which the housing mechanism 36 includes the plurality of magnets 60*c* provided at the turntable 60 and the magnetic sensor 66 to detect the rotation of the wire reel WR. Unlike this configuration, as shown in FIG. 28 for example, a configuration may be employed in which the housing mechanism 36 includes a plurality of reflector plates 192 provided at the turntable 60 and an optical sensor 194 to detect the rotation of the wire reel WR. In the configuration shown in FIG. 28, the optical sensor 194 includes a light emitter 194*a* configured to emit laser light for detection toward the wire reel WR and a light receiver 194*b* configured to receive laser light that was reflected by any one of the reflector plates. Each of the light emitter 194*a* and the light receiver 194*b* of the optical sensor 194 is electrically connected to the control board 200. The plurality of reflector plates 192 is attached to the rotation detector 60*b* of the turntable 60, with a predetermined angular interval provided between each pair of the reflector plates. The optical sensor 194 is disposed outside the right housing 16. The right housing 16 is provided with a through hole, which is not shown, such that the light emitter 194*a* and the light receiver 194*b* of the optical sensor 194 are exposed to the wire reel WR. According to the configuration shown in FIG. 28, the control board 200 can detect the rotation of the wire reel WR from changes in light detected by the light receiver 194*b* of the optical sensor 194.

The above embodiment describes the configuration in which the drive gear 78 and the driven gear 80 grip the wire W and feed it out in the feed mechanism 38, however, the drive gear 78 and the driven gear 80 may respectively be a drive roller and a driven roller that are not provided with teeth on side surfaces thereof.

The above embodiment describes the rebar tying machine 2 configured to tie the plurality of rebars R with the wire W, however, another element other than the wire W may be used as a tying string, and another element other than the plurality of rebars R may be tied.

Representative, non-limiting examples of the present disclosure have been described in detail with reference to the attached drawings. This detailed description is merely intended to teach a person of skill in the art further details for practicing preferred aspects of the present teachings and is not intended to limit the scope of the present disclosure. Furthermore, each of the additional features and teachings disclosed above may be utilized separately or in conjunction with other features and teachings to provide improved tying machines, as well as methods for using and manufacturing the same.

Moreover, combinations of features and steps disclosed in the above detailed description may not be necessary to practice the present disclosure in the broadest sense, and are instead taught merely to particularly describe representative examples of the present disclosure. Furthermore, various features of the above-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

While specific examples of the present disclosure have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present disclosure is not limited to the combinations described at the time the claims are filed. Further, the purpose of the examples illustrated by the present description or drawings is to satisfy multiple objectives simultaneously, and satisfying any one of those objectives gives technical utility to the present disclosure.

What is claimed is:

1. A tying machine, comprising:

a feed mechanism including:

a feed roller configured to feed a tying string;

a feed motor configured to rotate the feed roller;

a cover disposed between the feed roller and the feed motor, and including a through hole;

a suppression member configured to suppress movement of dust from a feed roller side to a feed motor side via the through hole; and a guide member disposed on the feed roller side as seen from the cover and configured to guide the tying string to the feed roller, wherein the suppression member is a dust-proof bearing, and the guide member is fixed to the cover so as to prevent the suppression member from being removed from the cover.

2. The tying machine according to claim 1, further comprising a rotation transmission mechanism configured to transmit rotation of the feed motor to the feed roller via the through hole.

3. The tying machine according to claim 1, wherein the feed mechanism further includes a reduction mechanism disposed on the feed motor side as seen from the cover and configured to reduce rotation of the feed motor and transmit it to the feed roller.

4. The tying machine according to claim 1, wherein at least the feed roller, the feed motor, the cover and the suppression member are configured as a unit.

5. The tying machine according to claim 1, wherein the guide member includes an insertion hole through which the tying string is guided, and as seen from the guide member, an inlet of the insertion hole is open to at least an opposite side from a cover side.

* * * * *